US008875718B2

(12) United States Patent
Dinh

(10) Patent No.: US 8,875,718 B2
(45) Date of Patent: Nov. 4, 2014

(54) METHOD FOR MULT-LAYER EYELASH PAINTING

(76) Inventor: Daniel Phu Dinh, Beverly Hills, CA (US)

( * ) Notice: Subject to any disclaimer, the term of this patent is extended or adjusted under 35 U.S.C. 154(b) by 0 days.

(21) Appl. No.: 13/399,945

(22) Filed: Feb. 17, 2012

(65) Prior Publication Data

US 2012/0145173 A1 Jun. 14, 2012

Related U.S. Application Data

(63) Continuation-in-part of application No. 12/584,295, filed on Sep. 2, 2009, now Pat. No. 8,752,562, which is a continuation of application No. 11/473,943, filed on Jun. 23, 2006, now Pat. No. 7,600,519.

(51) Int. Cl.

| | |
|---|---|
| ***A41G 3/00*** | (2006.01) |
| ***A41G 5/02*** | (2006.01) |
| *A45D 44/00* | (2006.01) |

(52) U.S. Cl.

CPC .. *A41G 5/02* (2013.01); *A45D 44/00* (2013.01)
USPC ..... 132/201; 132/216

(58) Field of Classification Search

USPC ..... 132/201, 216, 217, 53
See application file for complete search history.

(56) References Cited

U.S. PATENT DOCUMENTS

| | | | | |
|---|---|---|---|---|
| 1,831,801 | A | | 9/1931 | Birk |
| 1,897,719 | A | | 2/1933 | Birk |
| 3,516,422 | A | | 6/1970 | Bechtold et al. |
| 3,561,458 | A | | 2/1971 | Udes |
| 3,566,889 | A | | 3/1971 | Cole et al. |
| 3,596,666 | A | * | 8/1971 | Dooley ..... 132/53 |
| 3,833,007 | A | | 9/1974 | Jacobs |
| 3,880,175 | A | | 4/1975 | Hosokawa |
| 3,900,038 | A | | 8/1975 | Masters |
| 3,968,807 | A | | 7/1976 | Kraicer |
| 4,029,111 | A | | 6/1977 | Barton |
| 4,299,242 | A | | 11/1981 | Choe |
| D278,086 | S | | 3/1985 | Greenberg |
| 5,547,529 | A | | 8/1996 | Woolf |
| 6,536,445 | B2 | | 3/2003 | Kuroda |
| D510,159 | S | | 9/2005 | Song |
| 7,600,519 | B2 | | 10/2009 | Dinh |
| D632,018 | S | | 2/2011 | Nguyen |
| D632,019 | S | | 2/2011 | Nguyen |
| 8,113,218 | B2 | | 2/2012 | Nguyen |
| 8,127,774 | B2 | | 3/2012 | Dinh |
| 2003/0005941 | A1 | | 1/2003 | Iosilevich |
| 2005/0061341 | A1 | | 3/2005 | Choe |
| 2007/0023062 | A1 | | 2/2007 | McKinstry et al. |
| 2007/0272264 | A1 | | 11/2007 | Byrne |
| 2007/0295353 | A1 | | 12/2007 | Dinh |
| 2008/0196732 | A1 | | 8/2008 | Merszei |
| 2009/0217938 | A1 | | 9/2009 | Rabe et al. |

* cited by examiner

*Primary Examiner* — Rachel Steitz
(74) *Attorney, Agent, or Firm* — Tope-McKay & Associates

(57) ABSTRACT

A method for multi-layered eyelash painting is described. The method is directed to fastening a user's eyelashes against the user's face and then painting one layer of eyelashes at a time in a multi-layered approach. The eyelash paint is applied to the user's eyelashes one layer at a time such that eyelash paint is applied to a first layer of eyelashes and, thereafter, eyelash paint is applied to a second layer of eyelashes, thereby providing a user with eyelashes having eyelash paint attached thereto.

18 Claims, 23 Drawing Sheets

METHOD FOR MULT-LAYER EYELASH PAINTING

PRIORITY CLAIM

This is a Continuation-in-Part Application of U.S. application Ser. No. 12/584,295, filed on Sep. 2, 2009, and entitled, Eyelash Extensions and Method for Applying Eyelash Extensions," which is a Continuation Application of U.S. application Ser. No. 11/473,943, filed on Jun. 23, 2006, and entitled, "Eyelash Extensions and Method for Applying Eyelash Extensions," now U.S. Pat. No. 7,600,519.

BACKGROUND OF THE INVENTION (1) Field of Invention

The present invention relates to a method for painting eyelashes, and more particularly to a method for applying multiple layers of eyelash paint to a user's eyelashes.

(2) Description of Related Art

Beauty products have long been known in the aft. Users, women in particular, have sought a variety of beauty products to enhance their aesthetic appearance. For example, blush is often used to add color to a woman's cheeks. As another example, lipstick is traditionally used to add a variety of colors and features to a user's lips. To enhance the appearance of a user's eyelashes, the user often applies mascara. Mascara is applied to the user's eyelashes to thicken, lengthen, and bring color to the eyelashes.

A problem with mascara is that it is typically applied in a single layer that does not provide depth. Further, if a user were to apply multiple colors of mascara, the mascara would blend together to create an undesirable effect.

Therefore, there is a continuing need for a method of applying coloring to eyelashes that provides depth, volume, and length.

SUMMARY OF INVENTION

The present invention relates to a method for multi-layered eyelash painting. The method is directed to fastening a user's eyelashes against the user's face and then painting one layer of eyelashes at a time in a multi-layered approach. The eyelash paint is applied to the user's eyelashes one layer at a time such that eyelash paint is applied to a first layer of eyelashes and, thereafter, eyelash paint is applied to a second layer of eyelashes, thereby providing a user with eyelashes having eyelash paint attached thereto.

Prior to fastening the user's eyelashes against the user's face, the eyelashes can be cleaned and dried. Thereafter, the act of fastening the user's eyelashes further includes applying a patch underneath the user's lower eyelashes and fastening the user's lower eyelashes to the patch using a fastener (e.g., performed while the user's eyes are open). A fastener can then be applied to the user's upper eyelid. The user's upper eyelashes are then fastened to the upper eyelid using an eyelash fastener.

Further, in applying eyelash paint to the user's eyelashes in a multi-layered approach, a first layer of upper eyelashes is first removed from the eyelash fastener. Eyelash paint is then applied to at least one eyelash of the first layer to form a first painted eyelash layer. The first painted eyelash layer is then fastened to the user using a fastener. A second layer of upper eyelashes can then be removed from the eyelash fastener. Thereafter, eyelash paint is applied to at least one eyelash of the second layer to form a second painted eyelash layer. It should be noted that the paint applied to the eyelash layers can be the same or different colors. For example, different color paints can be applied to each of the first and second painted eyelash layers such that each of the painted eyelash layers are painted different colors.

In another aspect, the second painted eyelash layer is fastened to the user using a fastener. A third layer of upper eyelashes can then be removed from the eyelash fastener (via pulling from the eyelash fastener or removing the eyelash fastener). Eyelash paint is then applied to at least one eyelash of the third layer to form a third painted eyelash layer. The fasteners are then entirely removed from the eyelashes and painted eyelash layers to reveal a user with eyelashes painted in a multi-layered approach.

In yet another aspect, the eyelashes are painted alternately between a first eye and a second eye, such that the first painted eyelash layer is formed with respect to the first eye and then the second eye, with the second painted eyelash layer then being formed with respect to the first eye and then the second eye. Thereafter, the third painted eyelash layer is formed with respect to the first eye then the second eye.

BRIEF DESCRIPTION OF THE DRAWINGS

The objects, features and advantages of the present invention will be apparent from the following detailed descriptions of the various aspects of the invention in conjunction with reference to the following drawings, where.

DETAILED DESCRIPTION

Figure 1:
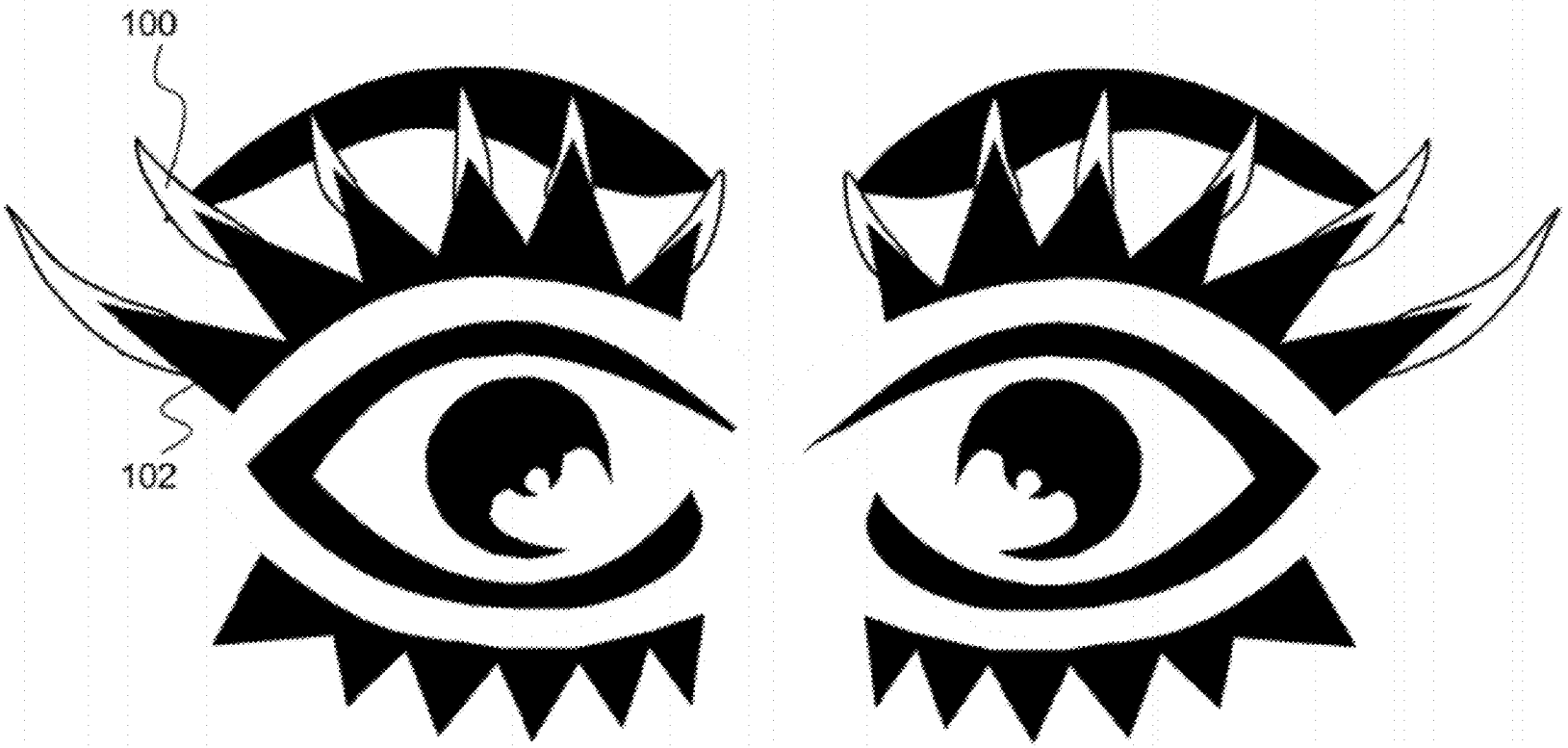
FIG. 1 is an illustration depicting a user's eyes with eyelash paint affixed to the user's eyelashes according to the multi-layered method of the present invention.

The present invention relates to a method for painting eyelashes, and more particularly to a method for applying multiple layers of eyelash paint to a user's eyelashes. The following description is presented to enable one of ordinary skill in the art to make and use the invention and to incorporate it in the context of particular applications. Various modifications, as well as a variety of uses in different applications will be readily apparent to those skilled in the art, and the general principles defined herein may be applied to a wide range of embodiments. Thus, the present invention is not intended to be limited to the embodiments presented, but is to be accorded the widest scope consistent with the principles and novel features disclosed herein.

In the following detailed description, numerous specific details are set forth in order to provide a more thorough understanding of the present invention. However, it will be apparent to one skilled in the art that the present invention may be practiced without necessarily being limited to these specific details. In other instances, well-known structures and devices are shown in block diagram form, rather than in detail, in order to avoid obscuring the present invention.

The reader's attention is directed to allpapers and documents which are filed concurrently with this specification and which are open to public inspection with this specification, and the contents of all such papers and documents are incorporated herein by reference. All the features disclosed in this specification, (including any accompanying claims, abstract, and drawings) may be replaced by alternative features serving the same, equivalent or similar purpose, unless expressly stated otherwise. Thus, unless expressly stated otherwise, each feature disclosed is one example only of a generic series of equivalent or similar features.

Furthermore, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of" or "act of" in the claims herein is not intended to invoke the provisions of 35 U.S.C. 112, Paragraph 6.

If used, the labels left, right, front, back, fop, bottom, forward, reverse, clockwise and counter clockwise have been used for convenience purposes only and are not intended to imply any particular fixed direction. Instead, they are used to reflect relative locations and/or directions between various portions of an object.

(1) Description

The present invention relates to method for multi-layered eyelash painting. In other words, the present invention is directed to a method for painting eyelashes using a multiple layer application technique. It should be noted that the term "paint" as used herein refers to any solution that can be applied to eyelashes, non-limiting examples of which include tint solutions (any color), perm, mascara, adhesive, color, and any other solutions that may be desirable to apply to a user's eyelashes.

It should also be noted that the term "user" is often used in relation to the person whose eyelashes are being used and depicted and does not necessarily refer to the user of the present invention. The actual user of the present invention is any person who performs the acts described and depicted herein, such as an eyelash clinician who is applying the eyelash paint to the "user's" eyes. Further details are provided below.

As shown in FIG. 1, after performing the method of the present invention, the user is left with eyelash paint 100 that is applied and adhered to the user's natural eyelashes 102. An advantage over the prior art is that the method described herein uses a multi-layered approach that allows for the application of different colors to individual eyelashes and/or provides a more robust and full finished look. For further understanding, the method is described and illustrated with respect to FIGS. 2 through 23.

Before applying any eyelash paint, the eyelashes can be prepared for application ofthe paint. Optionally, the user's eyelashes are cleaned using water or a cleaning solution. The eyelashes are then air-dried or dried using a fan or other drying mechanism.

Figure 2:
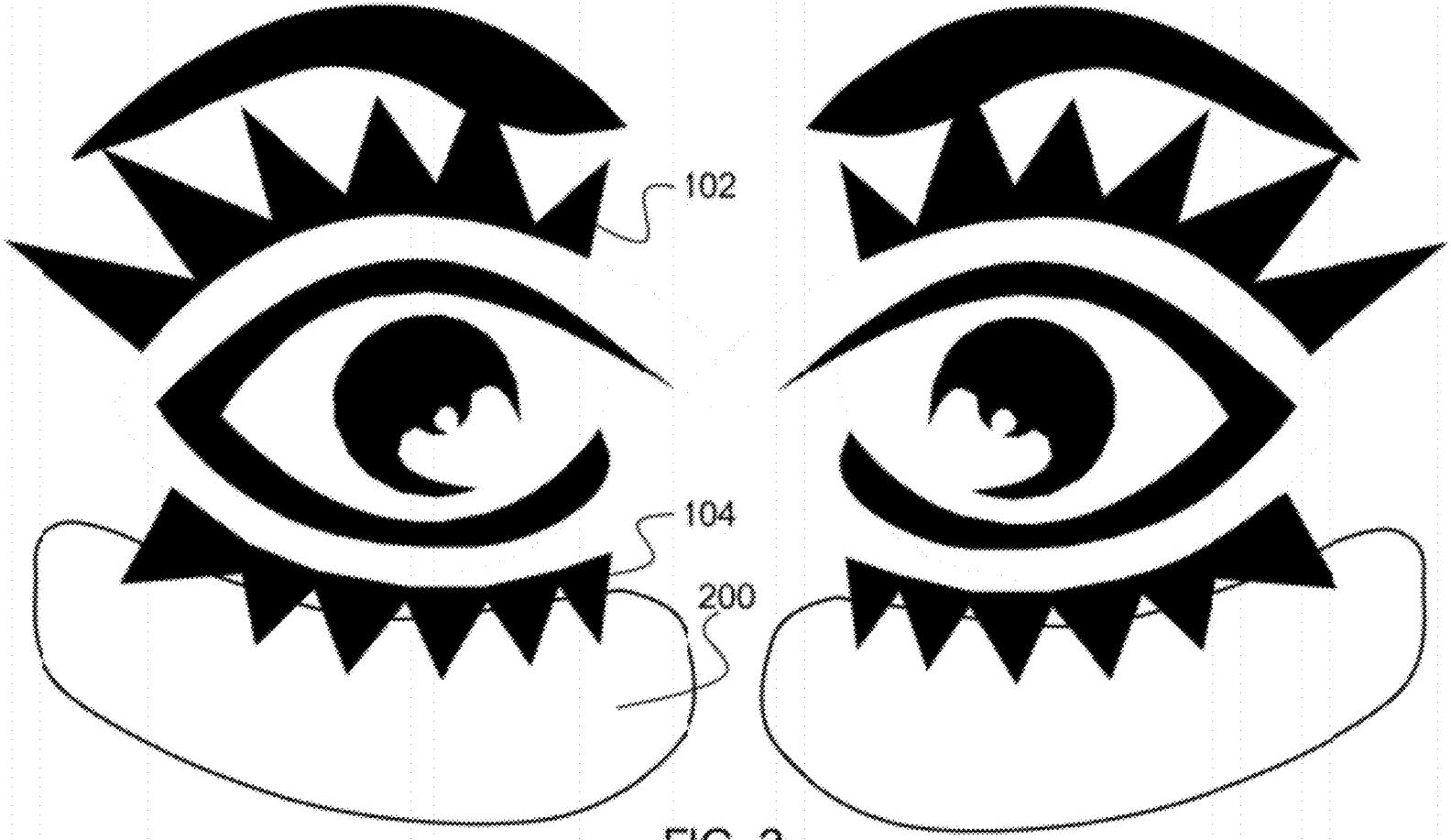
FIG. 2 is an illustration depicting a pad being affixed below the user's bottom eyelashes.

As shown in FIG. 2, after drying the eyelashes 102, a patch 200 is affixed to the user below the lower eyelashes 104. The patch 200 is any mechanism or device for creating a barrier upon the surface of the user's skin, non-limiting examples of which include a gel patch and tape.

Figure 3:
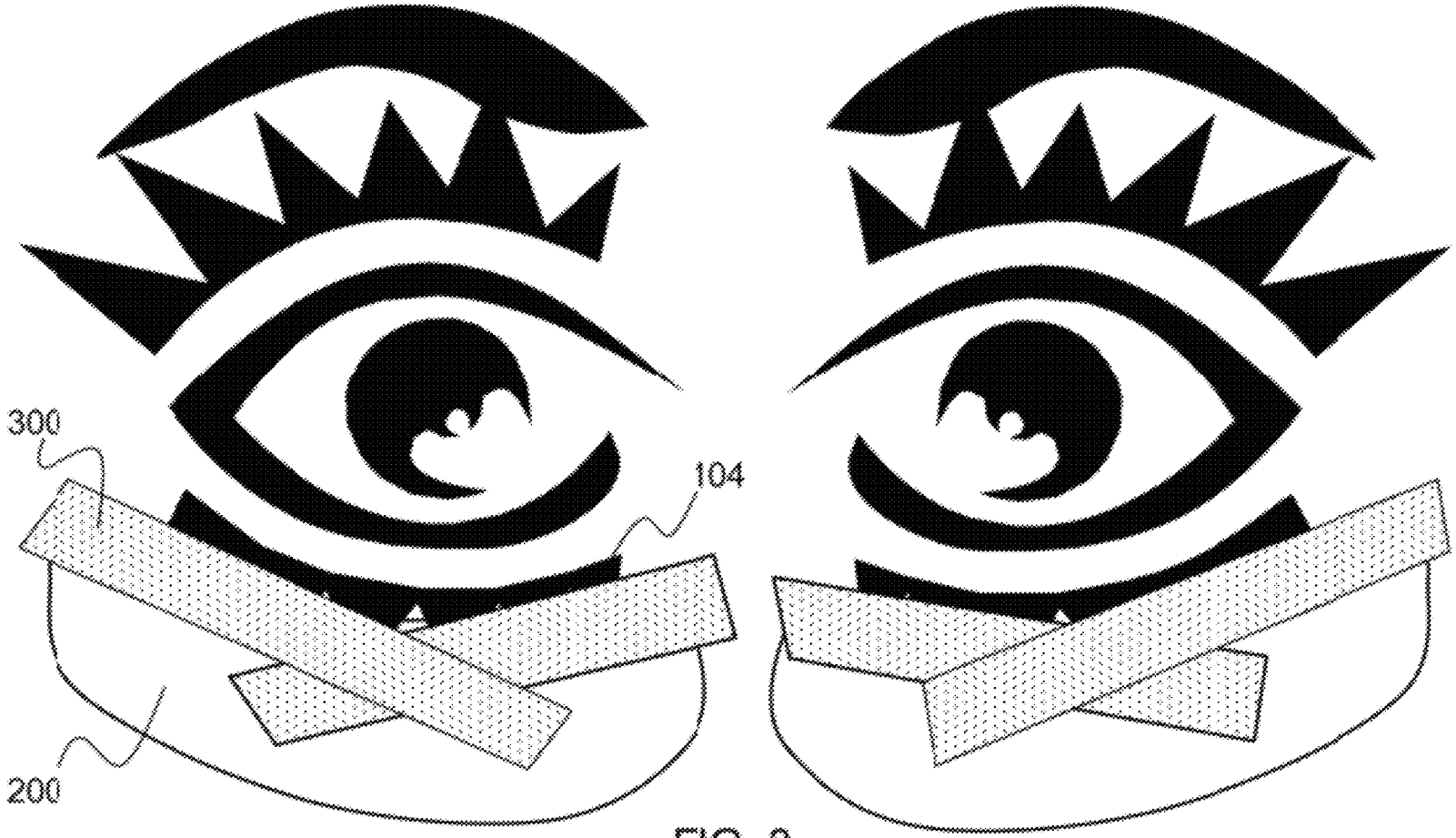
FIG. 3 is an illustration depicting the placement of tape over the user's bottom eyelashes.

As shown in FIG. 3, the lower eyelashes 104 are then fastened to the patch 200 using a fastener 300. It should be noted that the user's eyes are typically open at this point. However, this act can also be performed while the eyes are closed, or with one eye closed while the other is open. The fastener 300 is any mechanism or device for fastening one object against another, a non-limiting example of which includes tape.

Figure 4:
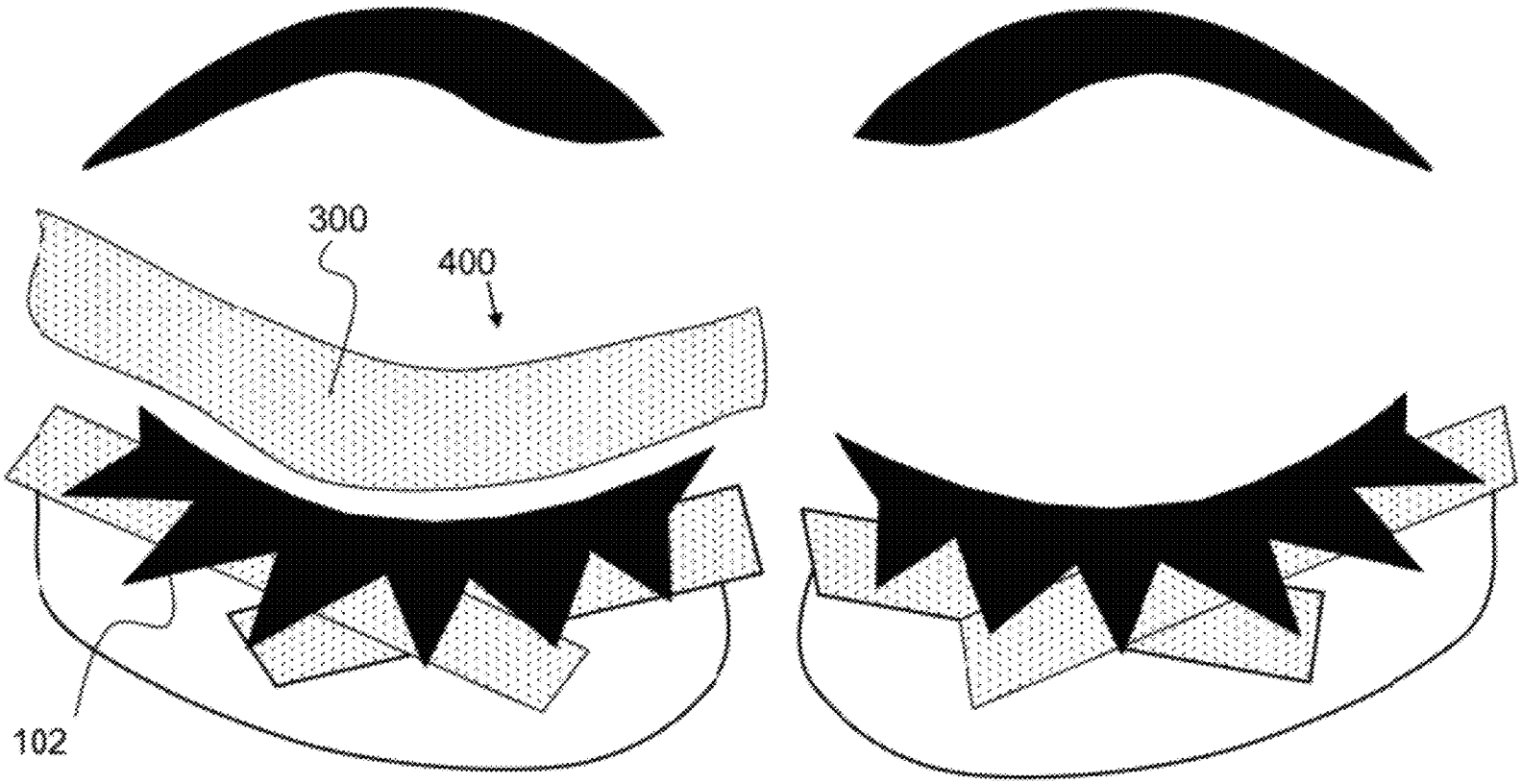
FIG. 4 is an illustration depicting the placement of tape over the user's top eyelid.

As shown in FIG. 4, with the user's eyes closed, a fastener 300 is applied to the user's upper eyelid 400. The fastener 300 is used to fasten the eyelid closed in order to prevent the user from opening the eye during treatment. The fastener 300 on the upper eyelid 400 provides additional benefits. For example, when taping up the upper eyelashes 102 (as described below), the eyelashes are prevented from touching the user's eyelid 400 (skin), thereby decreasing the risk of contaminating the eyelashes with oil from the user's skin. Additionally, when separating the eyelashes (as described below), tools used to separate the eyelashes do not touch the user's skin (increasing comfort).

Figure 5:
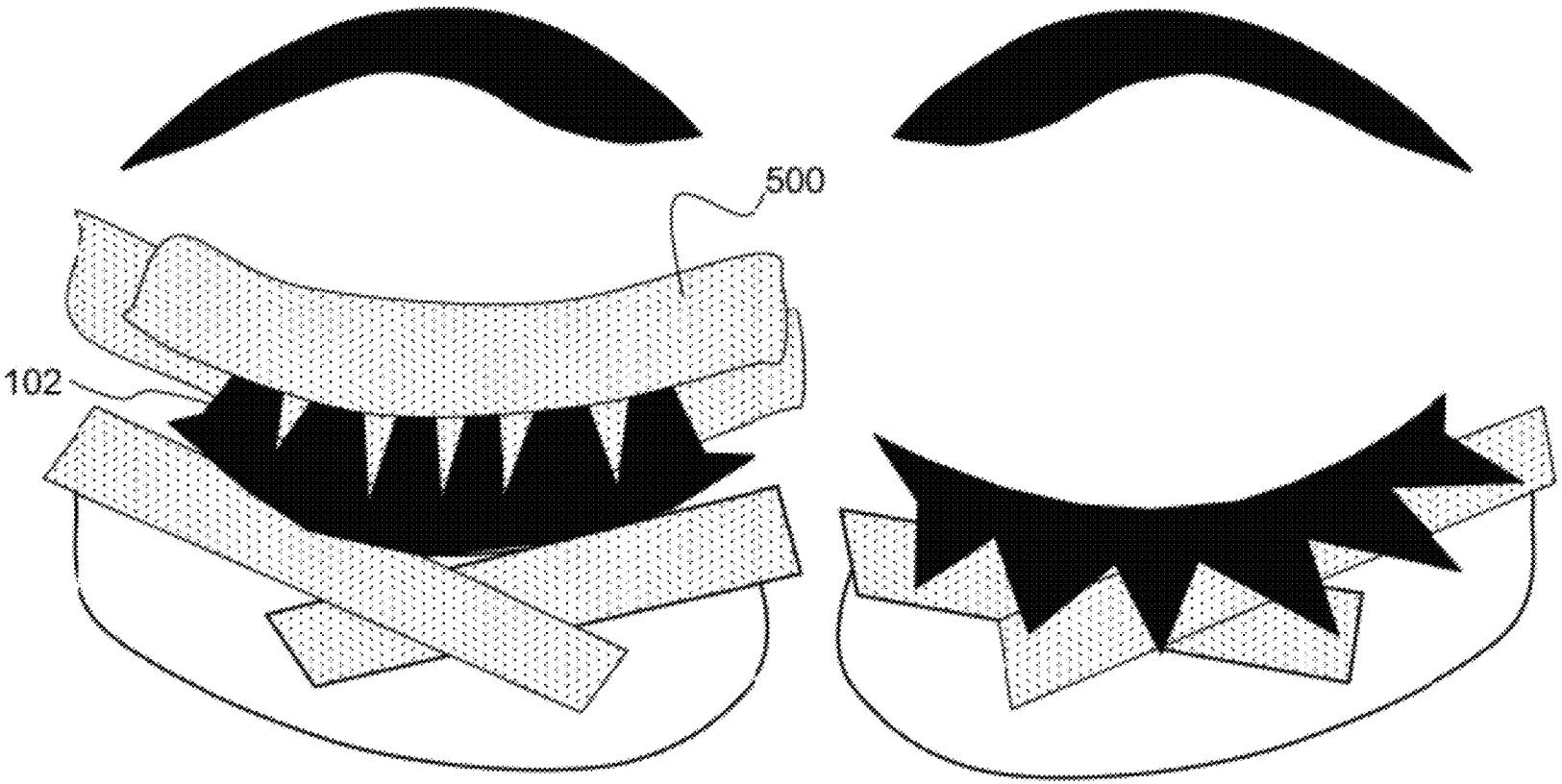
FIG. 5 is an illustration depicting the top eyelashes of a user being taped up.

As shown in FIG. 5, the upper eyelashes 102 are then fastened to the upper eyelid 400 using an eyelash fastener 500 (such as tape).

Figure 6:
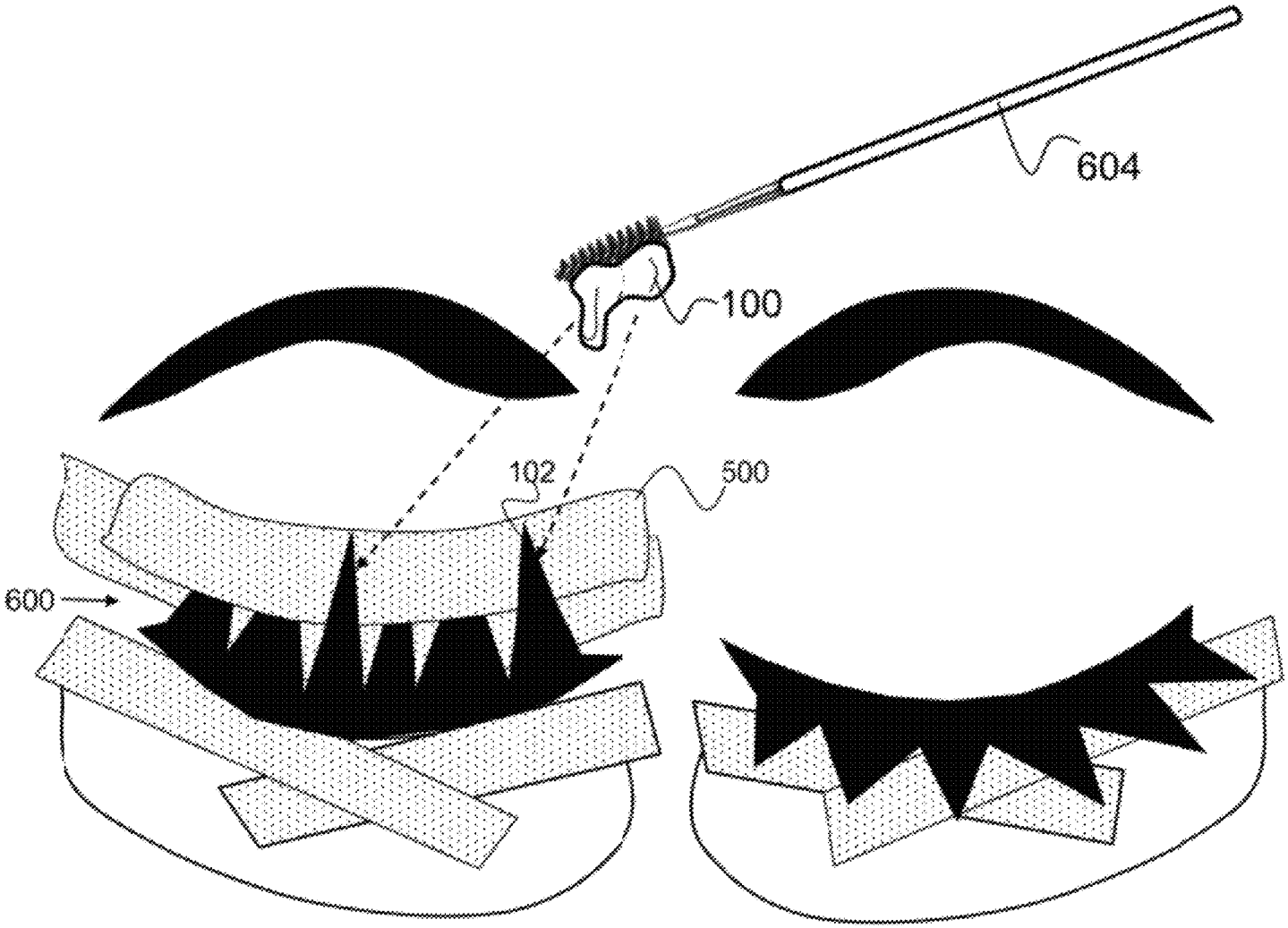
FIG. 6 is an illustration depicting eyelash paint being affixed to the user's eyelashes.

As shown in FIG. 6, a first layer of upper eyelashes 102 is removed from the eyelash fastener 500 on the user's first eye 600. The upper eyelashes 102 are removed by hand or using any suitable tool, such as tweezers. After a first layer of upper eyelashes 102 has been freed from the eyelash fastener 500, eyelash paint 100 is applied to the eyelashes 102 to create a first painted eyelash layer (which is shown as element 602 in FIG. 7). The eyelash paint 100 is applied to individual eyelashes 102 using a brush 604 or any other suitable application technique or device.

Figure 7:
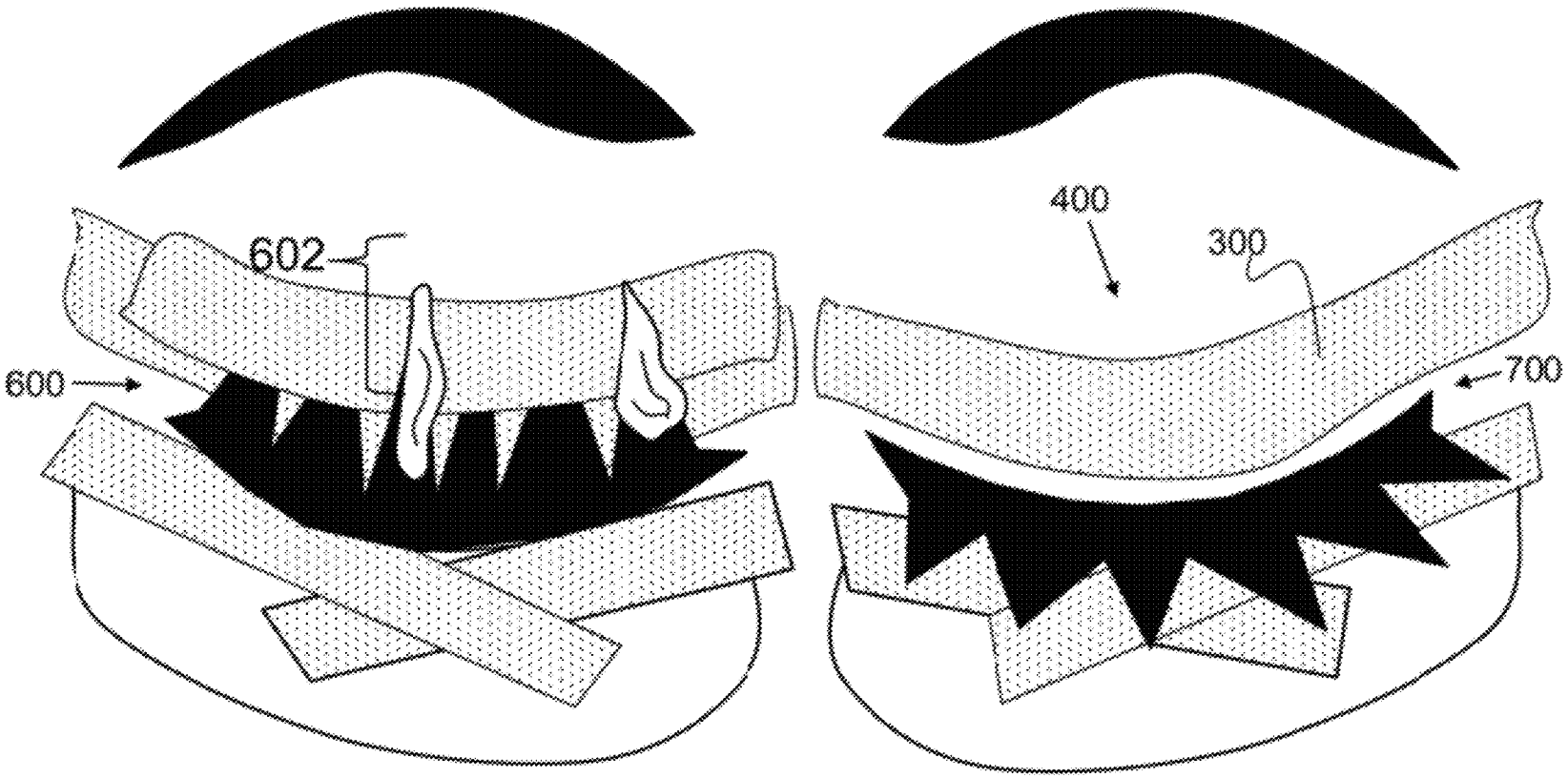
FIG. 7 is an illustration depicting the eyelash paint as affixed to the user's eyelashes and also depicting the placement of tape over the user's top eyelid.

As shown in FIG. 7, a fastener 300 is applied to the eyelid 400 of the user's second eye 700. Also as shown is the first painted eyelash layer 602 on the user's first eye 600.

Figure 8:
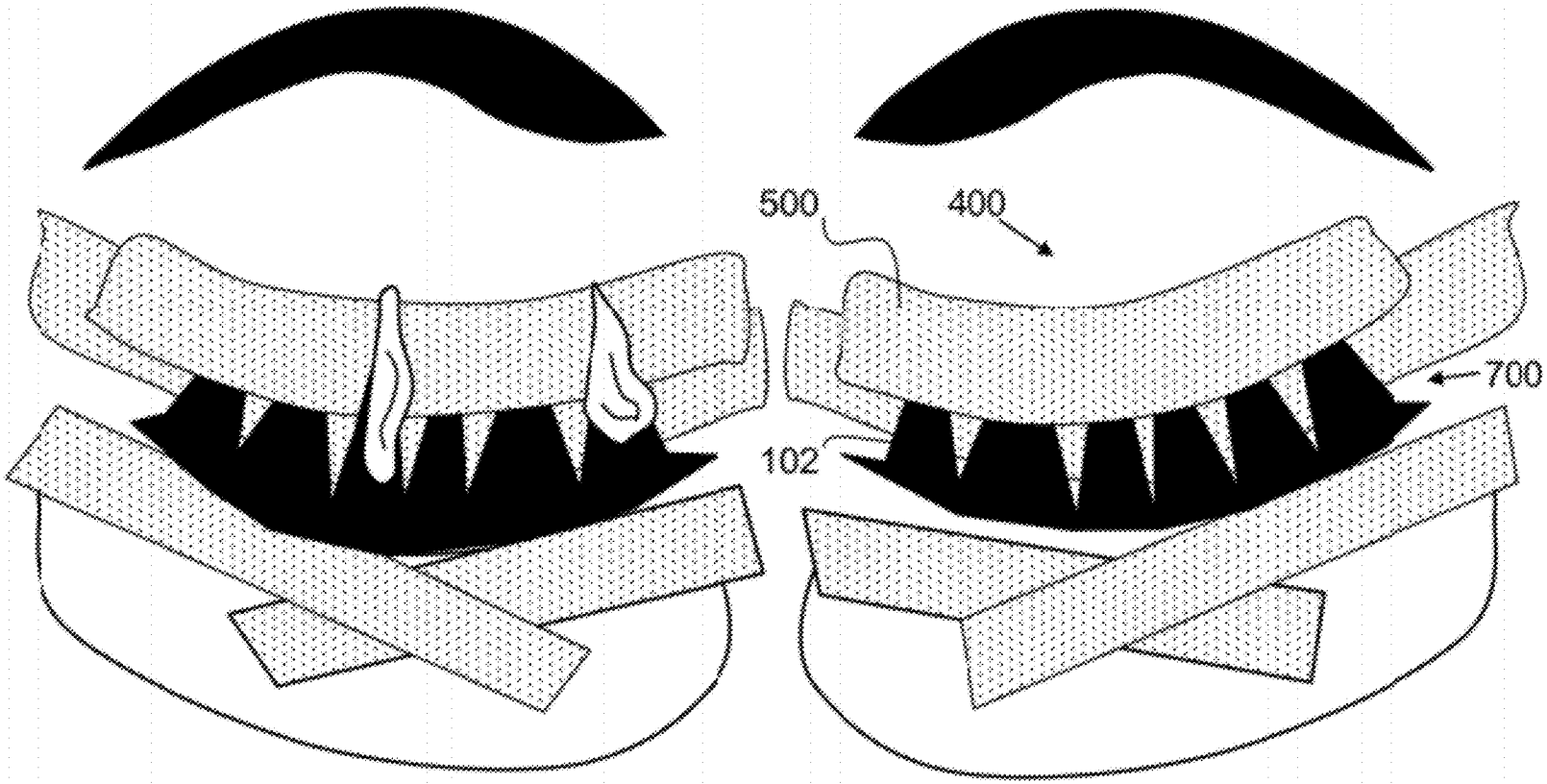
FIG. 8 is an illustration depicting the user's other top eyelashes being taped up.

As illustrated in FIG. 8, using an eyelash fastener 500, the user's upper eyelashes 102 are then fastened to the upper eyelid 400 of the user's second eye 700.

Figure 9:
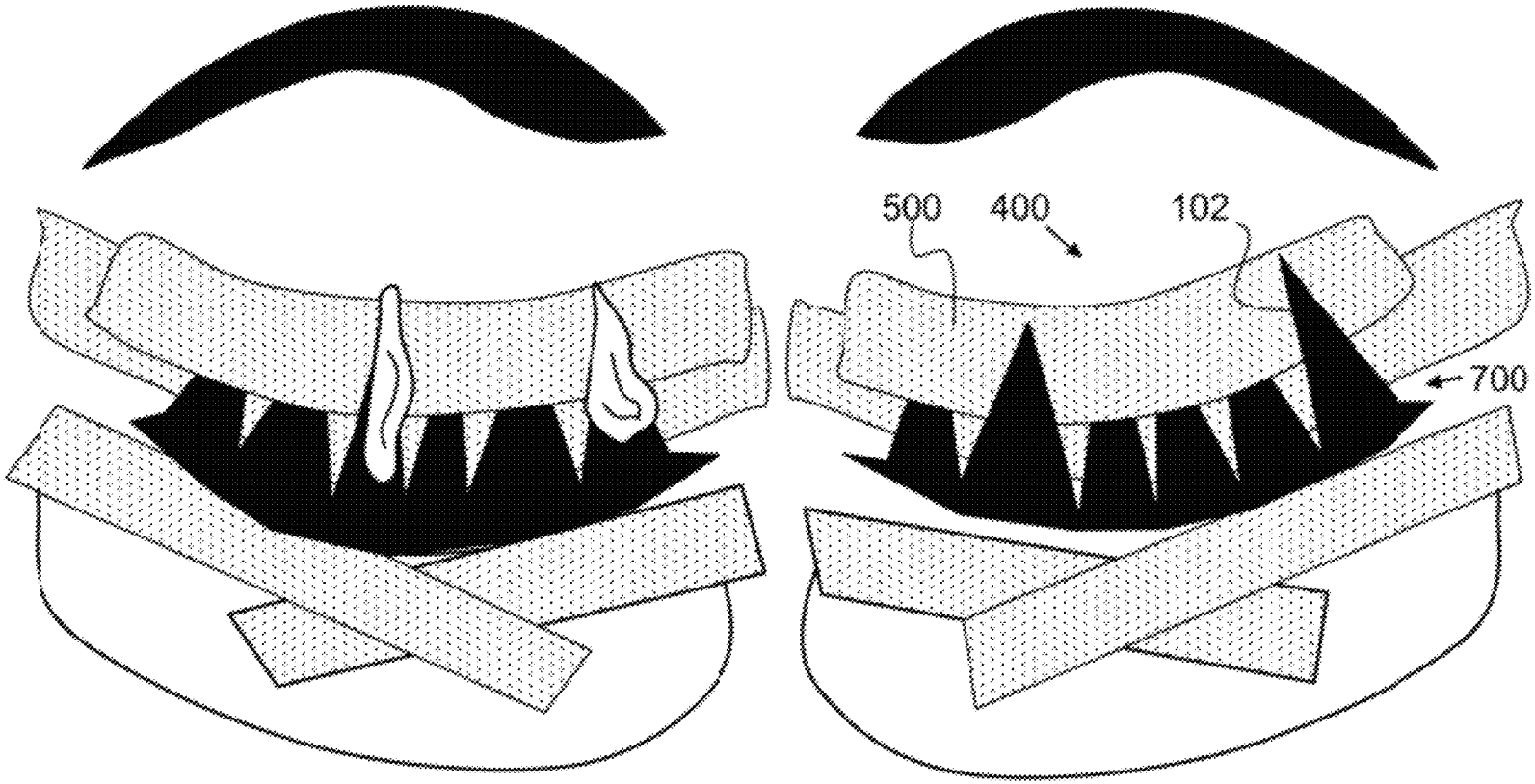
FIG. 9 is an illustration depicting the user's eyelashes being pulled from the tape.
Figure 10:
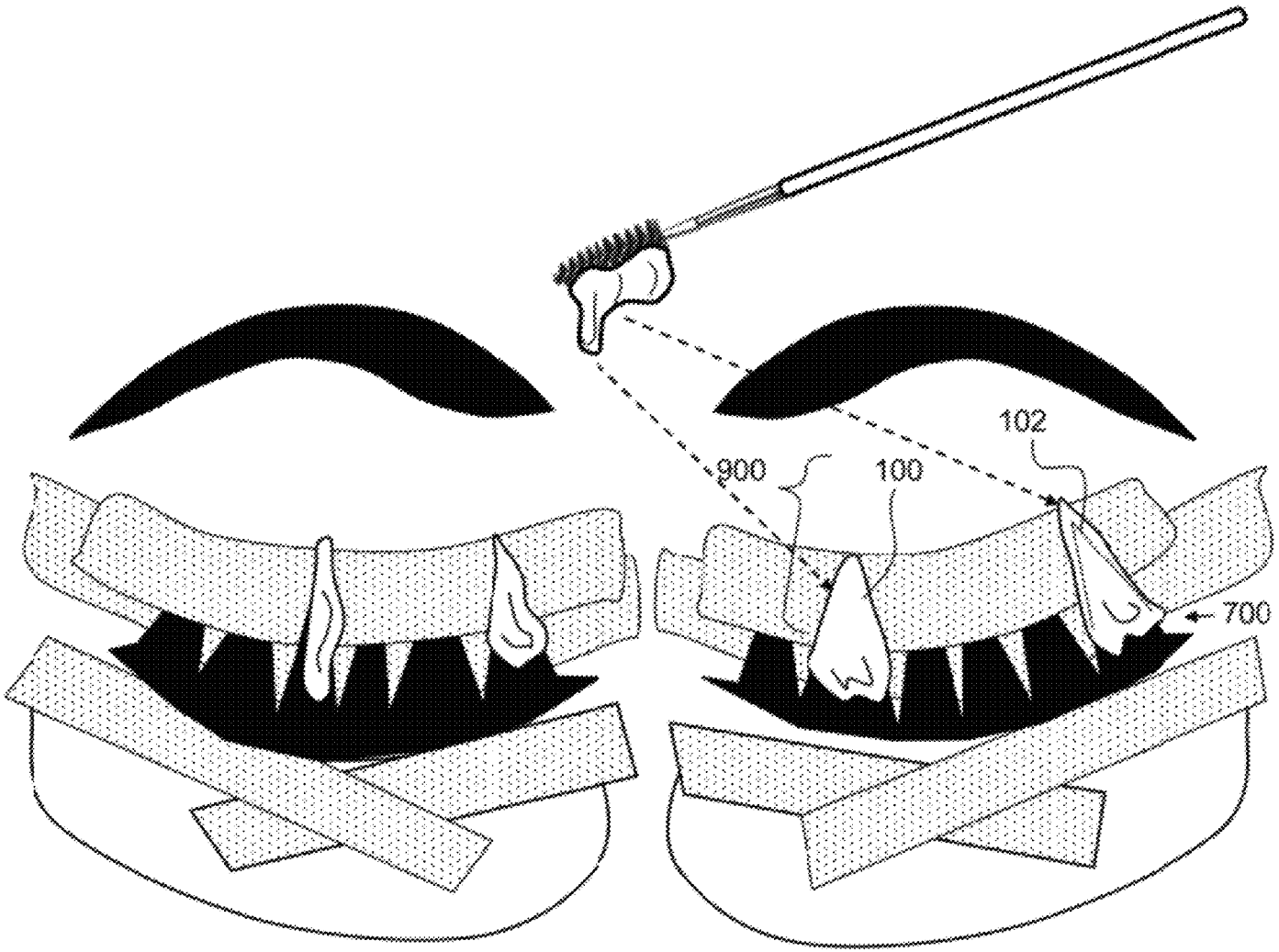
FIG. 10 is an illustration depicting eyelash paint being affixed to the user's eyelashes.

As shown in FIG. 9, a first layer of upper eyelashes 102 is removed from the eyelash fastener 500 of the user's second eye 700. Thereafter, as illustrated in FIG. 10, eyelash paint 100 is applied to the freed eyelashes 102, thereby creating a first painted eyelash layer 900 on the user's second eye 700.

Figure 11:
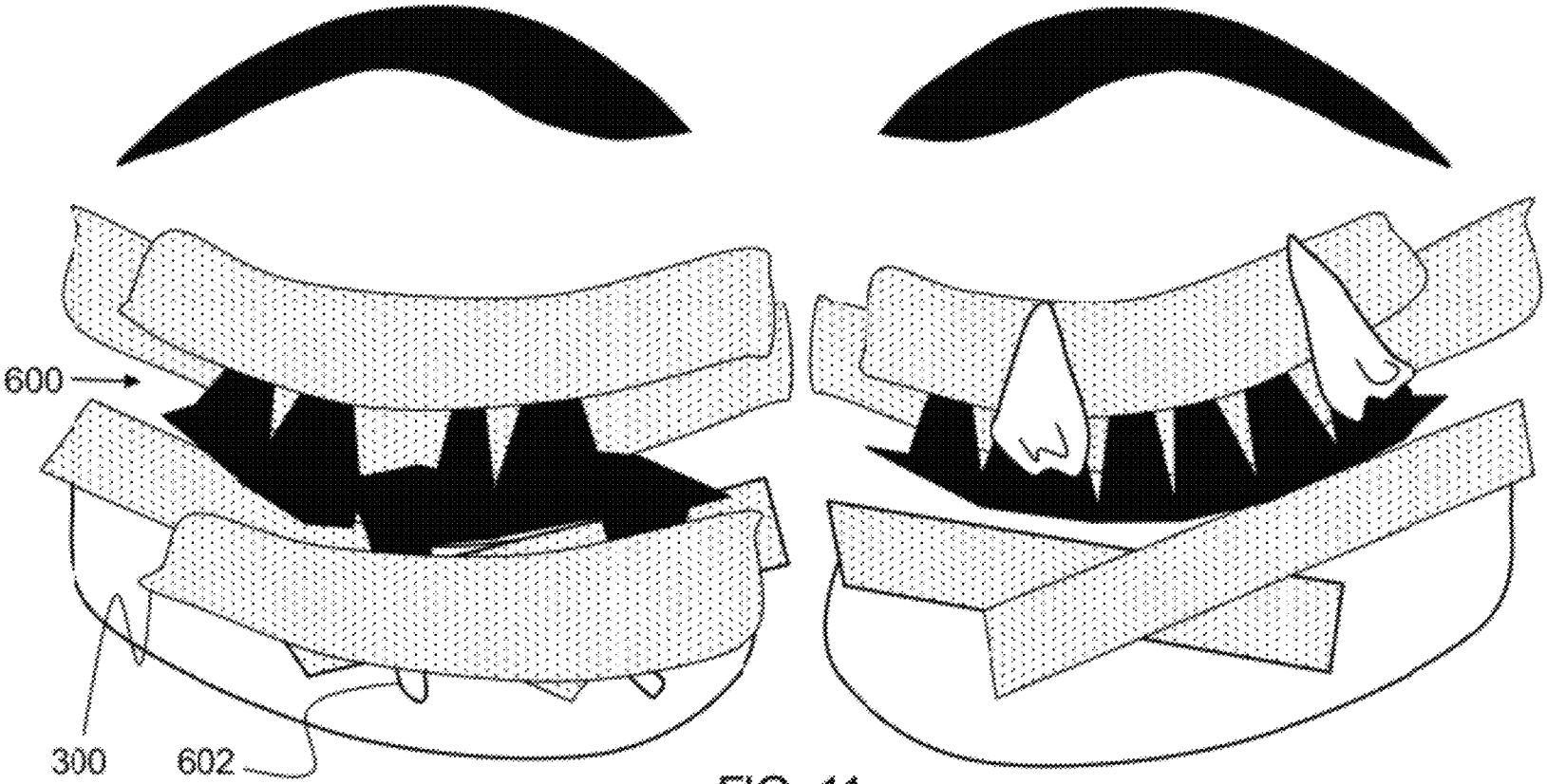
FIG. 11 is an illustration depicting the eyelashes with paint being taped down.
Figure 12:
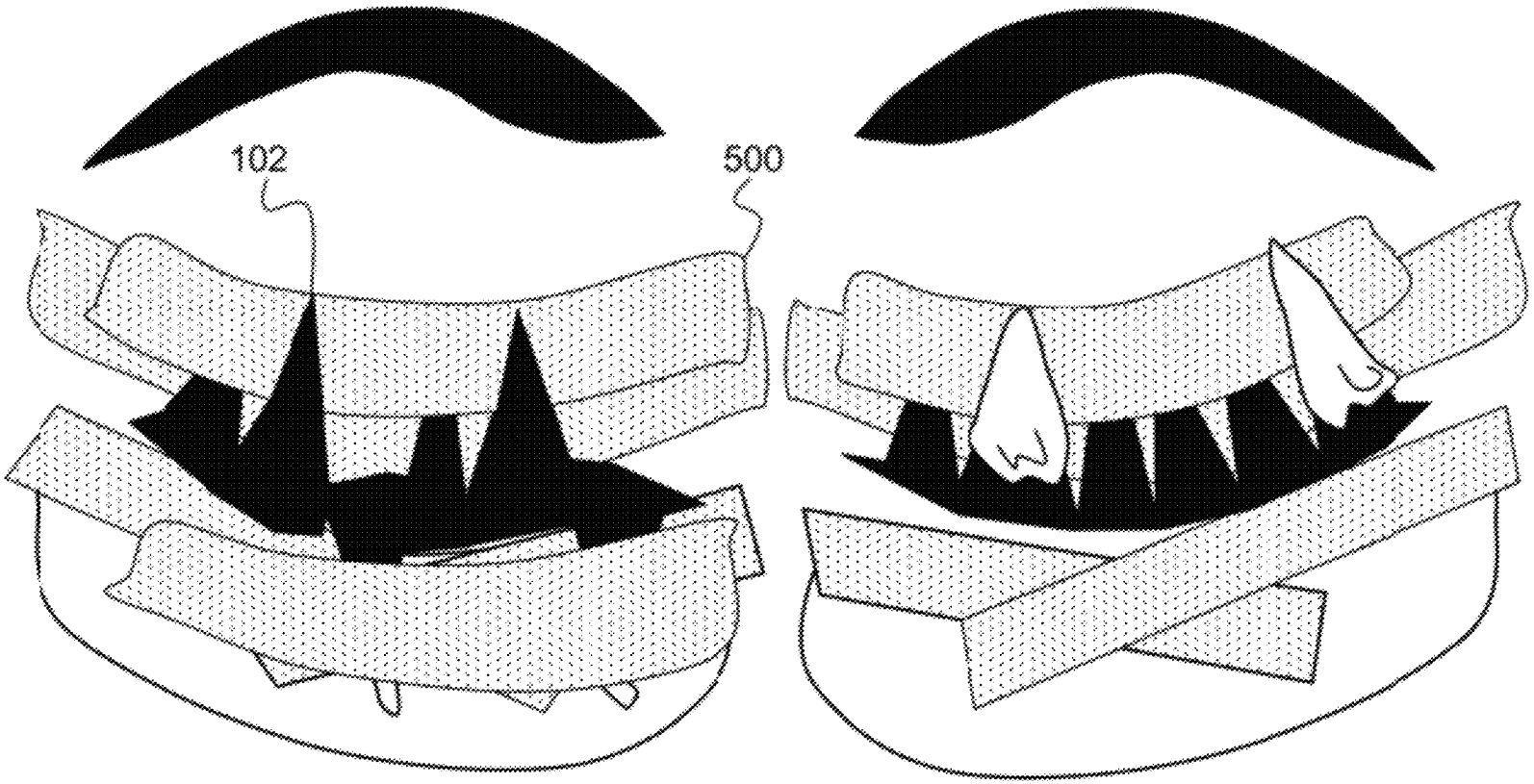
FIG. 12 is an illustration depicting the user's eyelashes being pulled from the tape.
Figure 13:
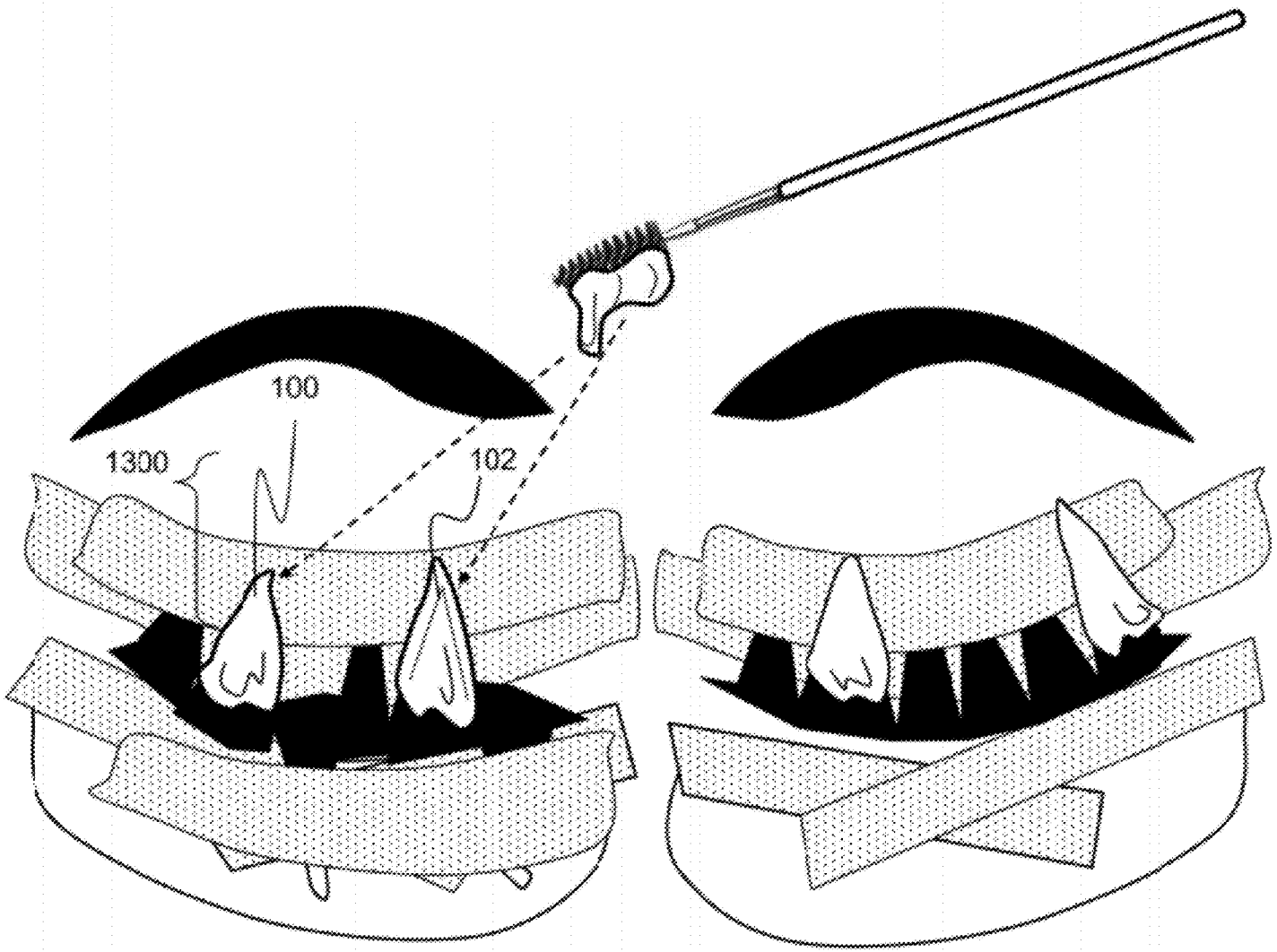
FIG. 13 is an illustration depicting eyelash paint being affixed to the user's eyelashes.

As shown in FIG. 11, a fastener 300 is then used to fasten the first painted eyelash layer 602 to the user, such as below the user's first eye 600. Next, as shown in FIG. 12, a second layer of upper eyelashes 102 is removed from the eyelash fastener 500. Thereafter, as show in FIG. 13, eyelash paint 100 is applied to the eyelashes 102 to form a second extended eyelash layer 1300.

Figure 14:
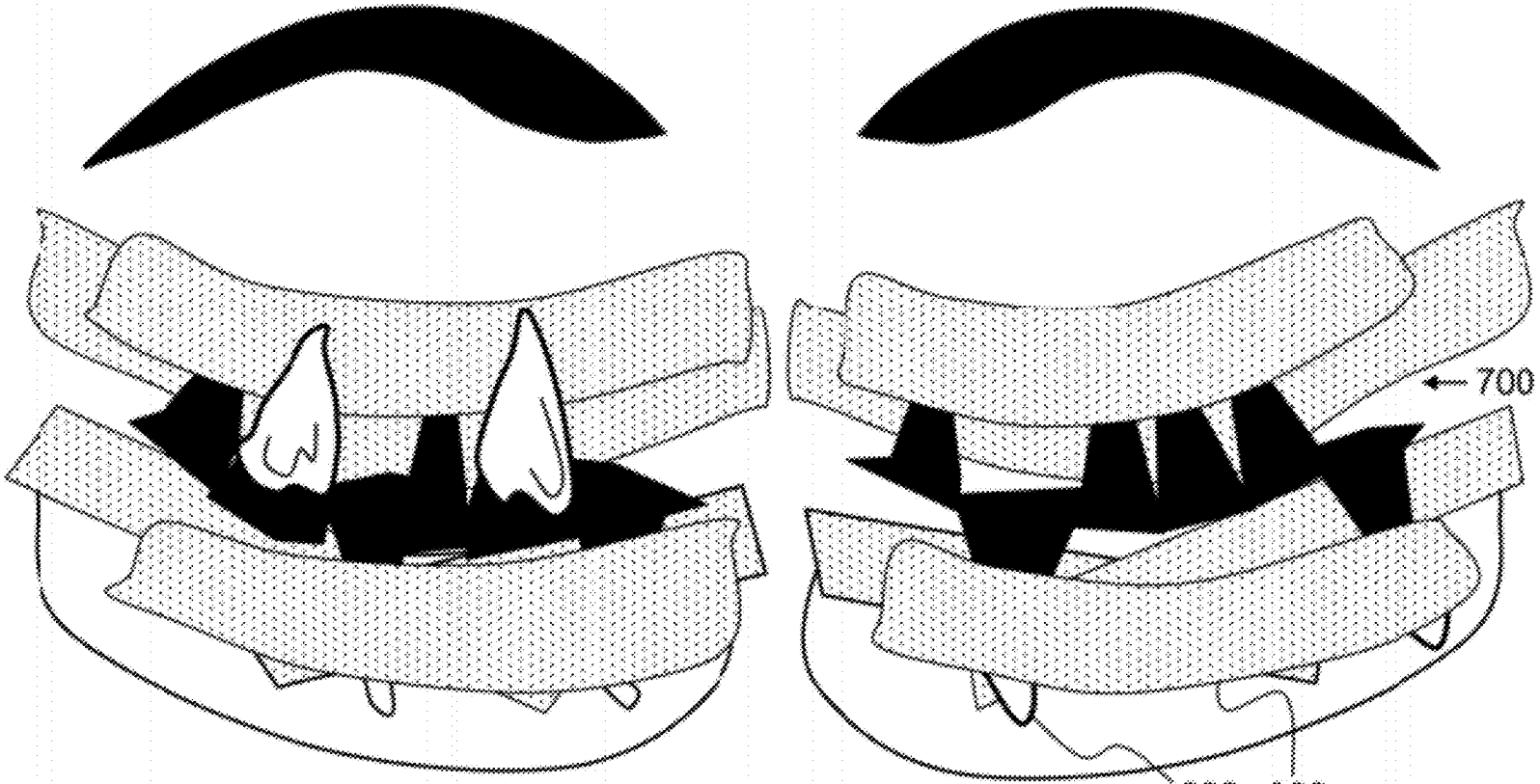
FIG. 14 is an illustration depicting the user's eyelashes with paint being taped down.
Figure 15:
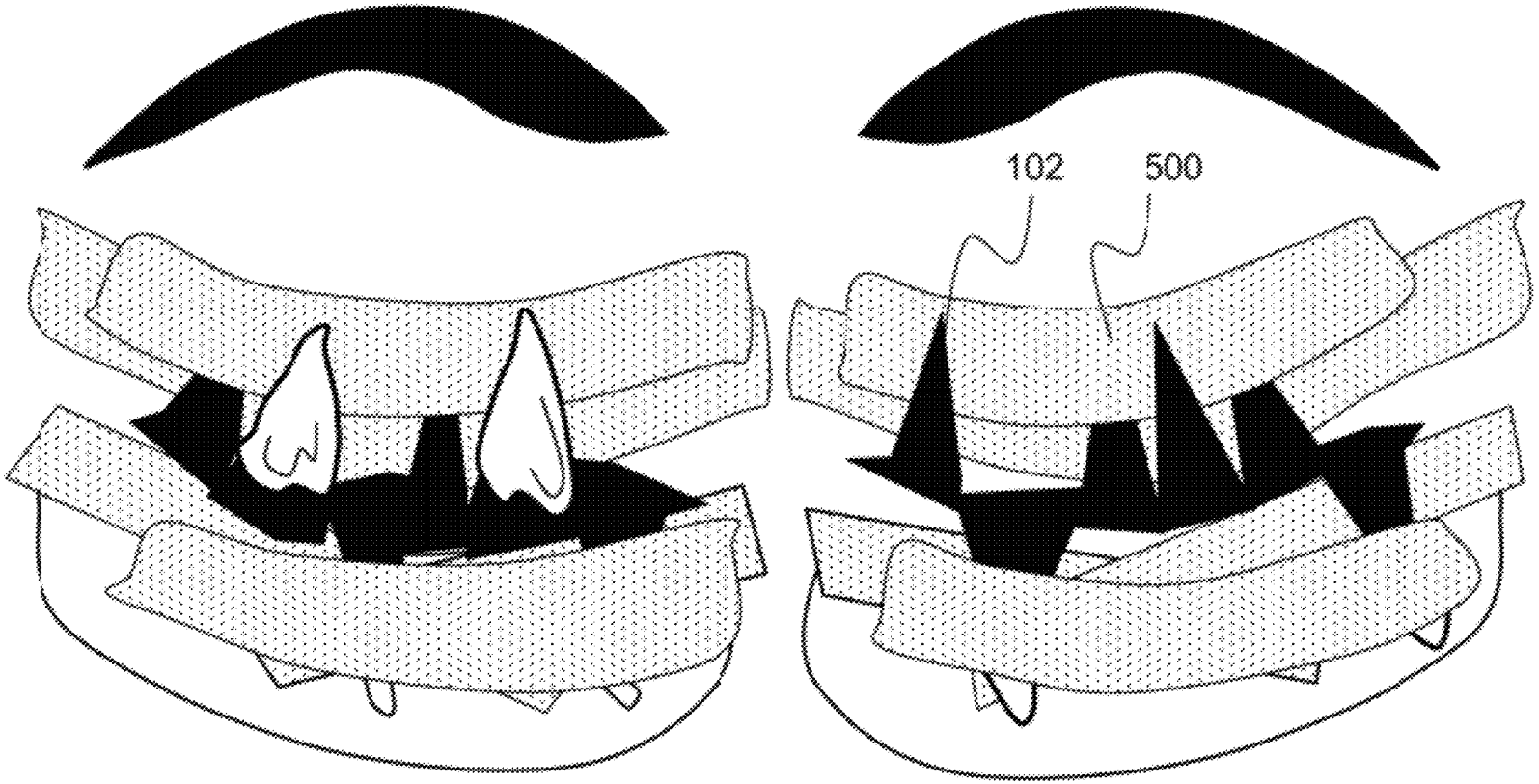
FIG. 15 is an illustration depicting the user's eyelashes being pulled from the tape.
Figure 16:
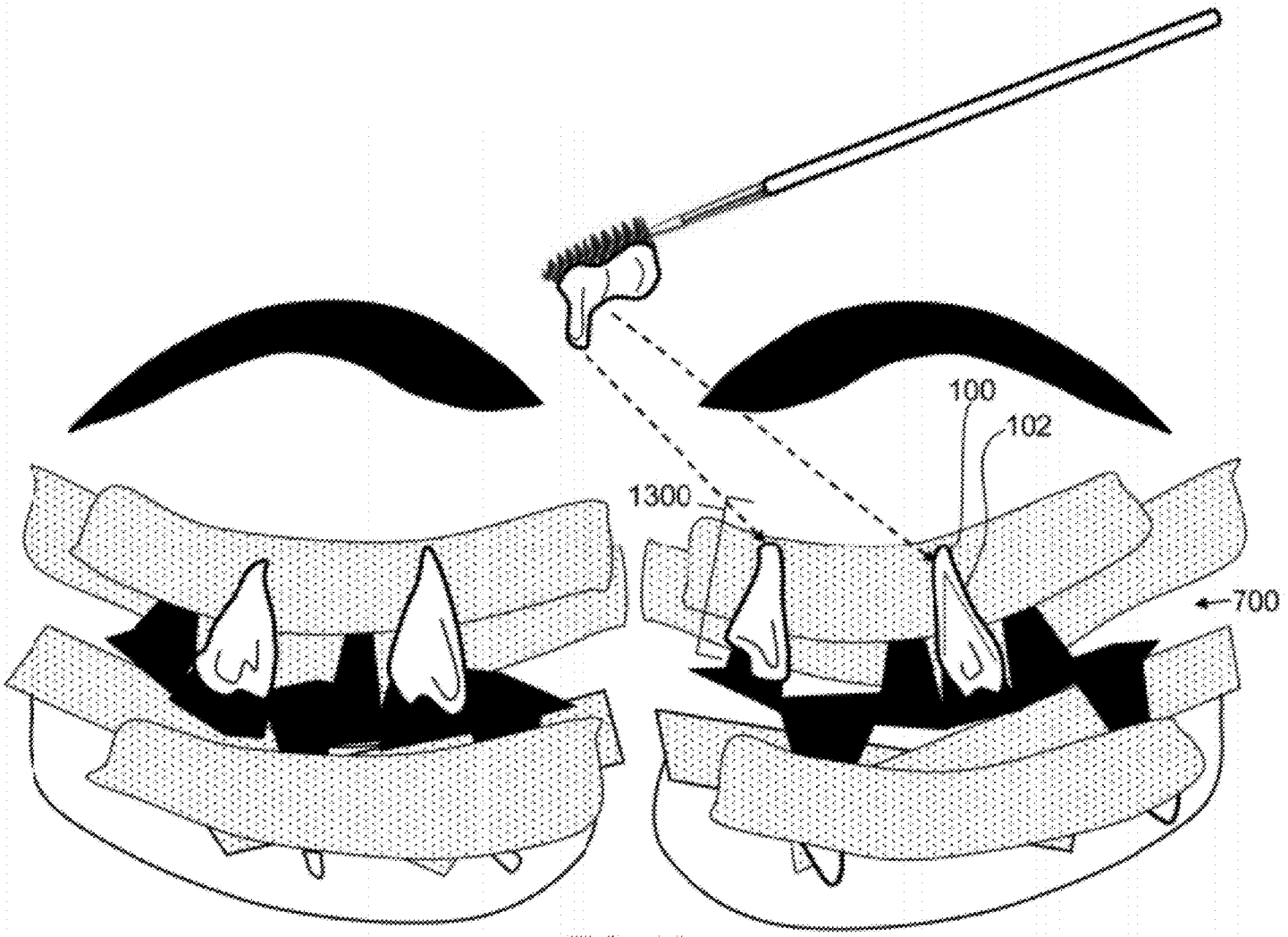
FIG. 16 is an illustration depicting eyelash paint being affixed to the user's eyelashes.

Next, as shown in FIG. 14, a fastener 300 is used to fasten the first painted eyelash layer 602 to the user, such as below the user's the second eye 700. As shown in FIG. 15, a second layer of upper eyelashes 102 is then removed from the eyelash fastener 500. As shown in FIG. 16, eyelash paint 100 is thereafter applied to the eyelashes 102 to form the second extended eyelash layer 1300 for the user's second eye 700.

Figure 17:
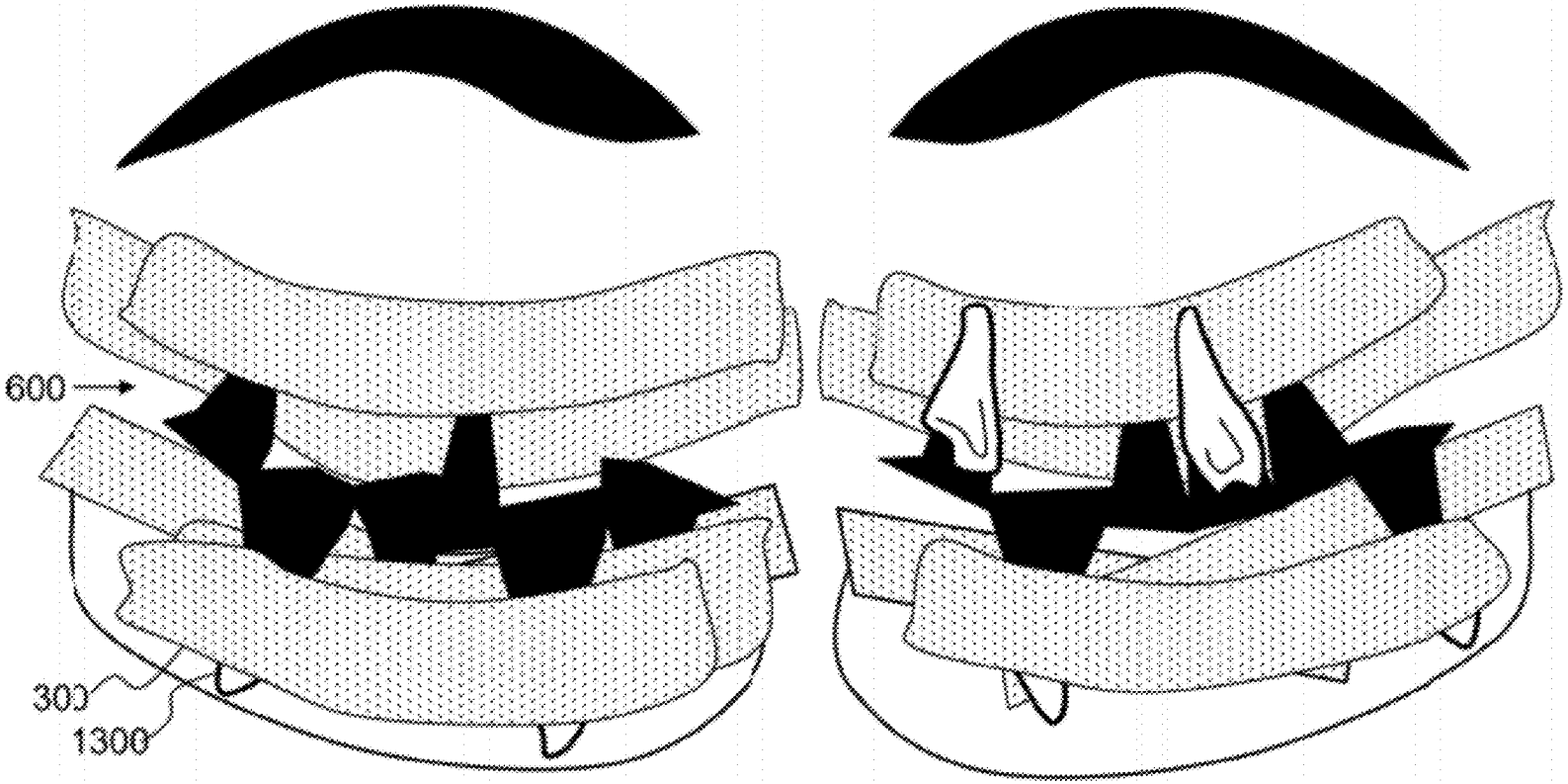
FIG. 17 is an illustration depicting the user's eyelashes with paint being taped down.

Next, as shown in FIG. 17, a fastener 300 is used to fasten the second extended layer 1300 to the user, such as below the user's first eye 600. The process described above can be repeated for any desired number of layers until reaching a last layer.

Figure 18:
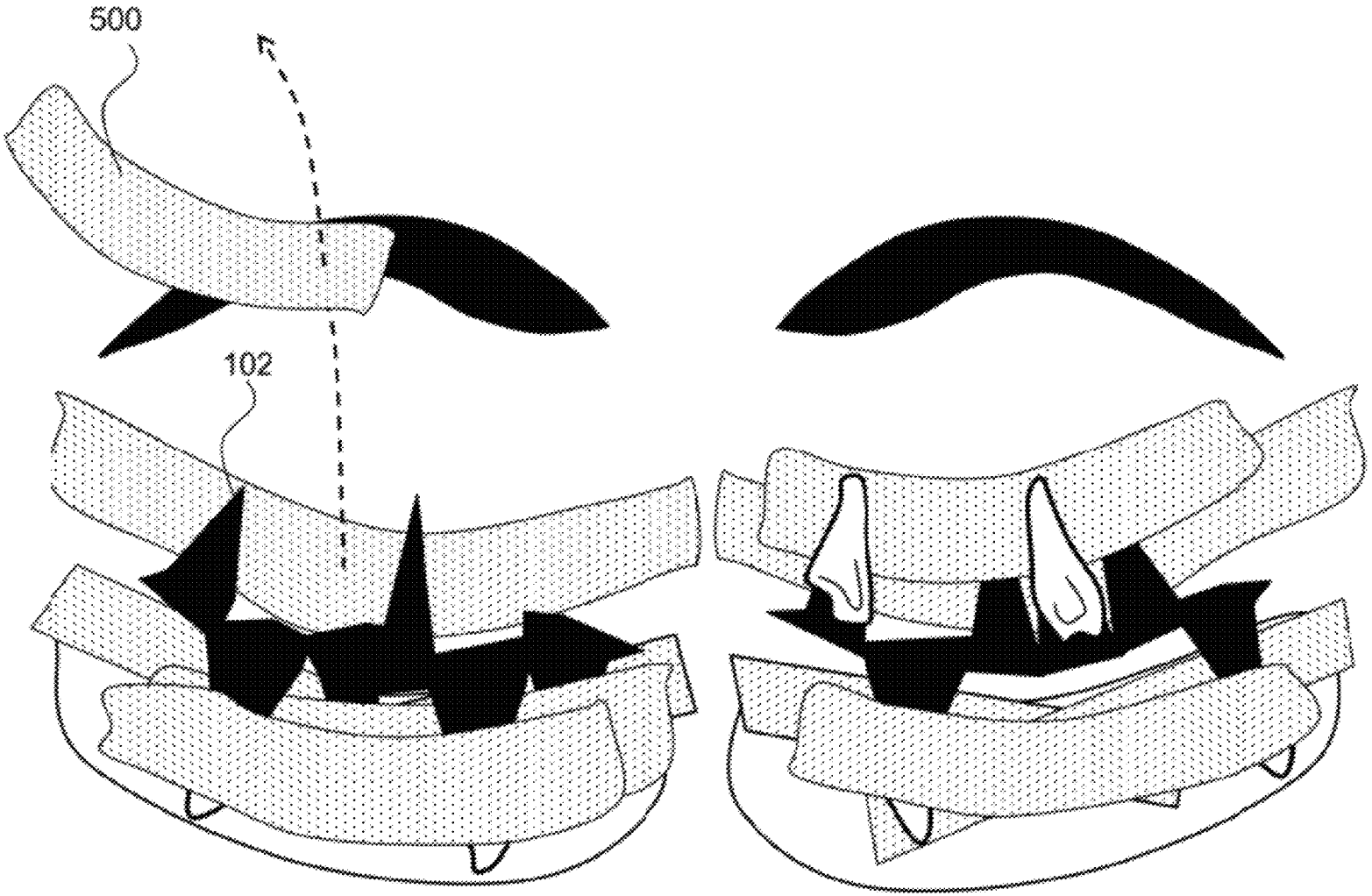
FIG 18 is an illustration depicting the user's eyelashes being released from the tape by removing the tape to expose the last layer of eyelashes.

As shown in FIG. 18, a last layer (in this example, a third layer) of upper eyelashes 102 is then separated from the eyelash fastener 500. The last layer of upper eyelashes 102 can be separated from the eyelash fastener 500 using any suitable technique, such as pulling the eyelashes 102 from the fastener 500 (as described above) or, as illustrated, removing the eyelash fastener 500 altogether. When removing the eyelash fastener 500, this exposes the last layer of upper eyelashes 102 for treatment.

Figure 19:
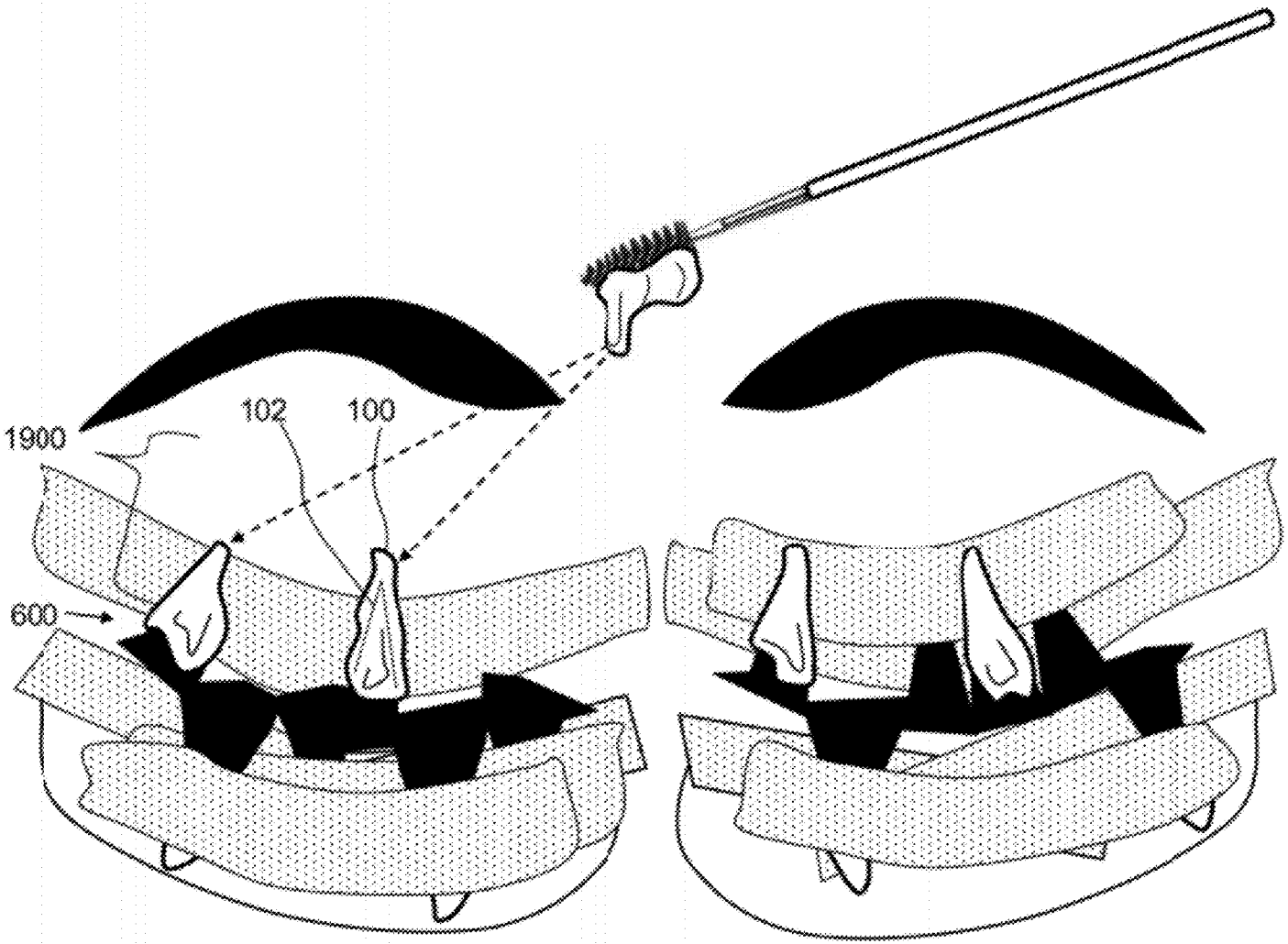
FIG. 19 is an illustration depicting eyelash paint being affixed to the user's last layer of eyelashes.

Next, as shown in FIG. 19, eyelash paint 100 is applied to the eyelashes 102 to form the last painted eyelash layer 1900 for the user's first eye 600.

Figure 20:
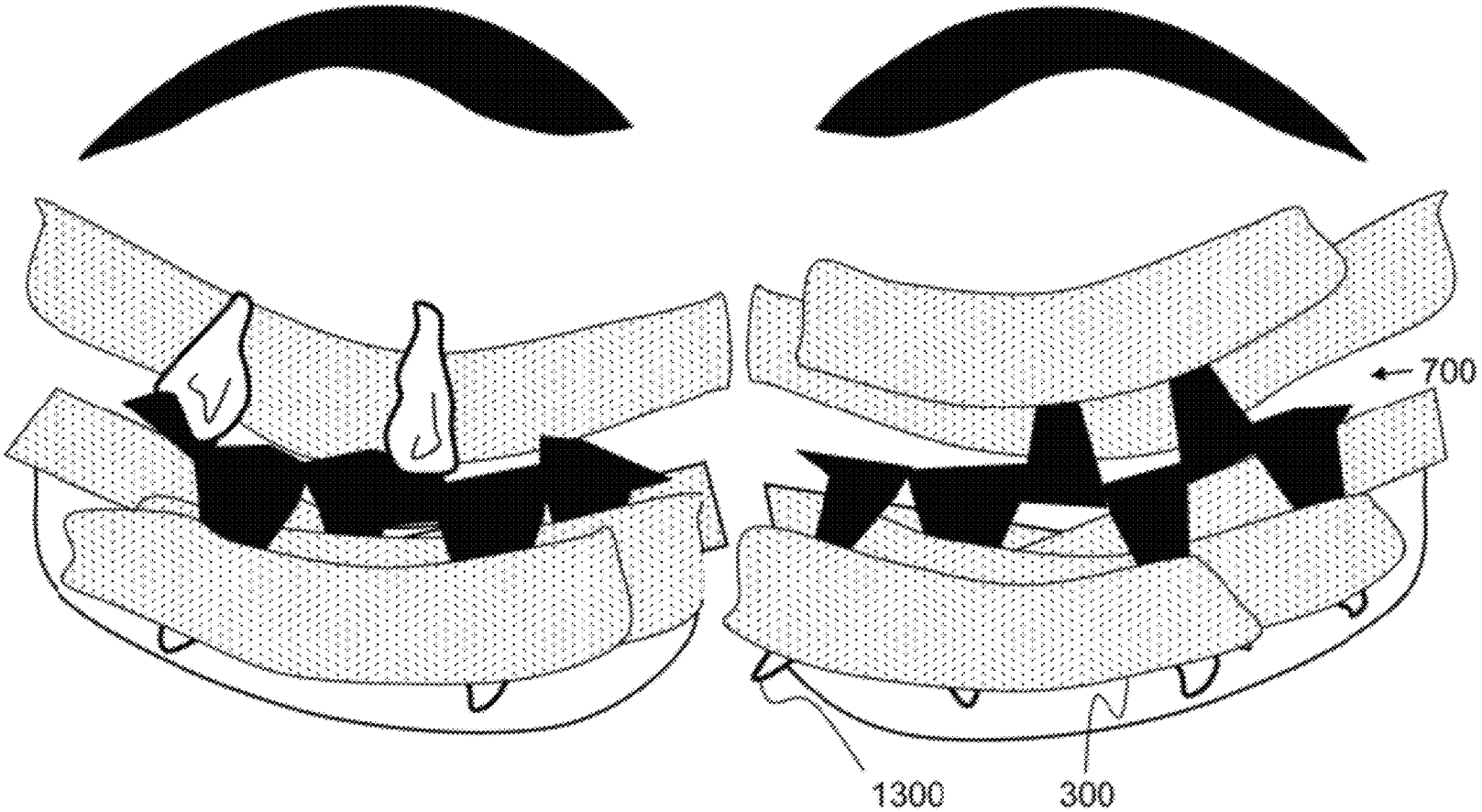
FIG. 20 is an illustration depicting the user's eyelashes with paint being taped down.
Figure 21:
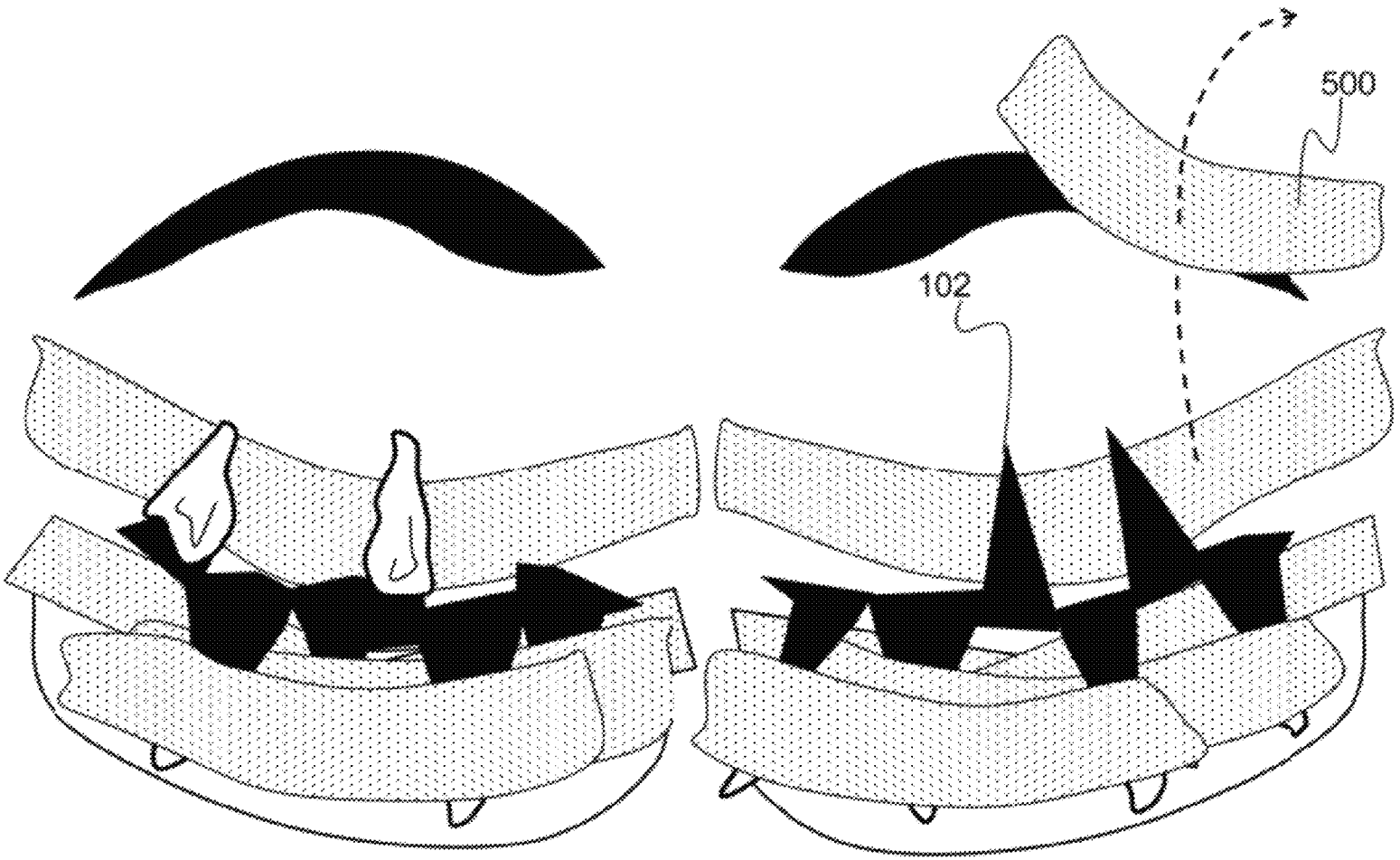
FIG. 21 is an illustration depicting the user's eyelashes being released from the tape by removing the tape to expose the last layer of eyelashes.

Returning to the user's second eye 700, as shown in FIG. 20, a fastener 300 is used to fasten the second painted layer 1300 to the user, such as below the user's second eye 700. Next, as shown in FIG. 21, a last layer of upper eyelashes 102 is removed from the eyelash fastener 500. As was the case above, the last layer of upper eyelashes 102 can be separated from the eyelash fastener 500 using any suitable technique, such as removing the eyelash fastener 500 altogether to expose the last layer of upper eyelashes 102.

Figure 22:
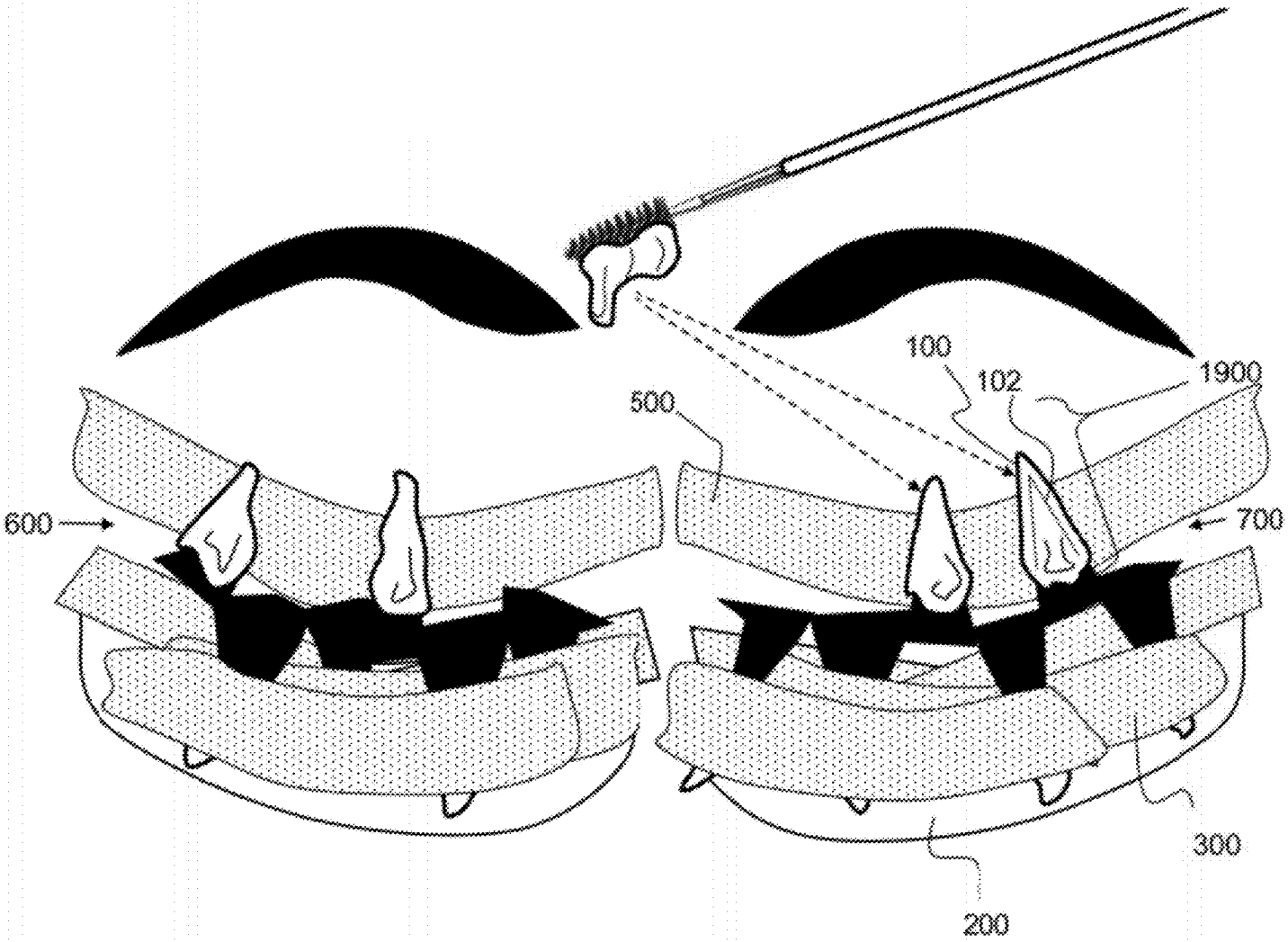
FIG. 22 is an illustration depicting eyelash paint being affixed to the user's last layer of eyelashes.

As shown in FIG. 22, eyelash paint 100 is thereafter applied to the eyelashes 102 to form the last painted eyelash layer 1900 for the user's second eye 700.

At this point, the eyelashes can be fixed. For example, adjacently stuck eyelashes are unstuck, eyelash paint can be applied to missed eyelashes, and the eyelash paint can be adjusted. Additionally, the user can then open their eyes to enable a comparison to ensure evenness of the eyelash paint 100 on the first eye 600 with those of the second eye 700. At this point, eyelash paint 100 can be removed, adjusted, or applied to ensure evenness between the two eyes 600 and 700. The remaining fasteners 300 and 500, and patches 200 can also be removed to allow the user to open their eyes without any restrictions.

After removing all of the fasteners from both eyes, the user is asked to look up, down, and around to further assure a desired (e.g., even) application ofthe eyelash paint. Additionally, eyelashes at the comers of both eyes are sometimes missed. Eyelash paint 100 can mrther be applied to eyelashes at the corners of the eyes to further ensure a natural look.

As described above, the eyelash paint 100 can be applied in a multi-layered approach to allow a user to wear eyelash paint 100 of different colors, textures, thickness, etc. Further, the multi-layered approach also provides a robust and full appearance to the user. As can be appreciated by one skilled in the art, the above process can be completed as few or as many times as the user desires layers of eyelash painting. For example, if the user desired only two layers, then the method described above would be stopped after the application of the second painted eyelash layer. Additionally, the method was described with the eyelash paint 100 being applied alternately between the first eye 600 and the second eye 700. Alternating the application allows time for the paint to dry on the first eye 600 while working on the second eye 700. A dried paint reduces the risk that the adhesive will stick to the fastener 300 when the fastener 300 is positioned over any of the painted eyelash layers. However, as can appreciated by one skilled in the art, the method described above can be completed by creating all of the painted eyelash layers on the first eye 600 prior to working on the second eye 700 (or any combination thereof).

Additionally, the painted eyelash layers were described as being fastened below the user's eyes prior to the application of an additional painted eyelash layers. As can be appreciated by one skilled in the art, the painted eyelash layers can also be applied and fastened to the user's upper eyelid between applications (instead of below the user's eyes).

Moreover, the upper eyelashes were described above as being initially fastened to the user's upper eyelids using the eyelash fastener. In another aspect, the upper eyelashes can be initially fastened below the user's eyes. In this aspect, the upper eyelashes are pulled from the eyelash fastener below the user's eye to allow for application of the eyelash paint. Thereafter, the upper eyelash extended layers are taped to the user's upper eyelid to enable a separation of the painted eyelash layers.

Furthermore, the final (last) layer of eyelash paint can be applied as described above with respect to the third extended eyelash layer (or other numeric layer as the case may be).

Figure 23:
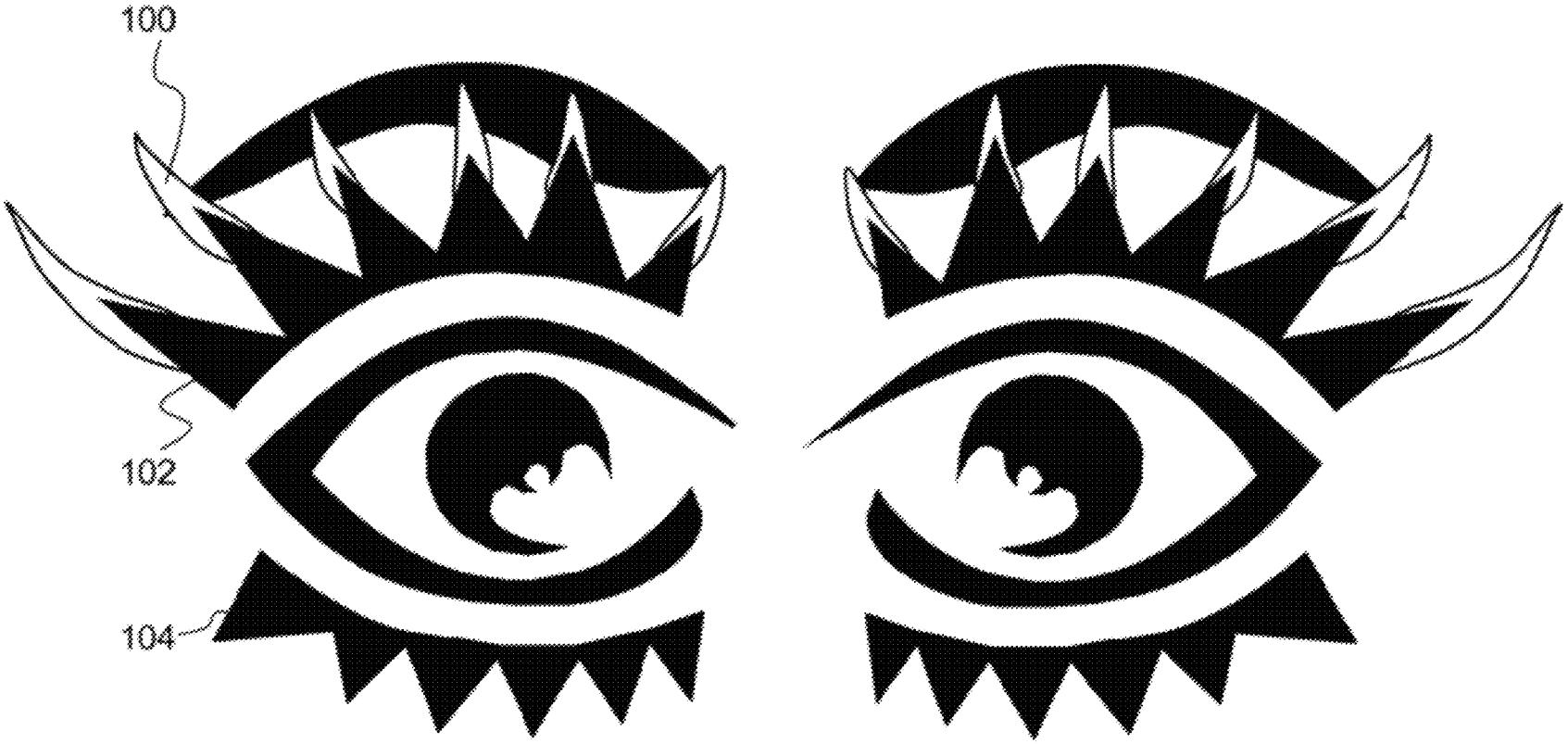
FIG. 23 is ah illustration depicting the user's eyes with eyelash paint affixed to the user's eyelashes after all of the tape has been removed.

FIG. 23 illustrates the result of the method of the present invention. As shown, eyelash paint 100 has been applied in a multi-layered approach to the user's upper eyelashes 102 to provide a desired and beautiful look. As can be appreciated by one skilled in the art, the present invention is not limited to the upper eyelashes 102 and the method described herein can also be used to apply eyelash paint to the lower eyelashes 104.

Finally, as can be appreciated by one skilled in the art, the method described herein can be used for any form of eyelash paint and is not limited to the paint illustrated herein, as it can be multi-colored, multi-textured, etc.

What is claimed is:

1. A method for multi-layer eyelash painting, comprising acts of:

fastening a user's upper eyelashes against the user's face using an eyelash fastener; and applying eyelash paint to the user's eyelashes in a multi-layered approach, the eyelash paint being a colored solution that provides color to the user's eyelashes when applied, wherein eyelash paint is applied to the user's eyelashes one layer at a time such that a first layer of upper eyelashes is removed from the eyelash fastener, with eyelash paint being applied to at least one eyelash of the first layer to form a first painted eyelash layer, thereby providing a user with eyelashes having eyelash paint attached thereto.

2. A method as set forth in claim 1, further comprising an act of cleaning the user's eyelashes prior to the act of fastening the user's eyelashes against the user's face.

3. A method as set forth in claim 2, further comprising an act of drying the user's eyelashes after cleaning the eyelashes.

4. A method as set forth in claim 3, wherein the user has upper eyelashes, lower eyelashes, and an upper eyelid, and wherein the act of fastening the user's eyelashes further comprises acts of:

applying a patch underneath the user's lower eyelashes;

fastening the user's lower eyelashes to the patch using a fastener;

applying a fastener to the user's upper eyelid; and fastening the user's upper eyelashes to the upper eyelid using an eyelash fastener.

5. A method as set forth in claim 4, wherein the act of applying eyelash paint to the user's eyelashes in a multi-layered approach farther comprises acts of:

removing the first layer of upper eyelashes from the eyelash fastener, applying eyelash paint to at least one eyelash of the first layer to form a first painted eyelash layer:

fastening the first painted eyelash layer to the user using a fastener;

removing the second layer of upper eyelashes from the eyelash fastener; and applying eyelash paint to at least one eyelash of the second layer to form a second painted eyelash layer.

6. A method as set forth in claim 5, wherein the paint applied to at least one eyelash of the first layer to form a first painted eyelash layer is a first color and the paint applied to at least one eyelash of the second layer to form a second painted eyelash layer is a second color, such that each of the first and second painted eyelash layers are painted different colors.

7. A method as set forth in claim 6, wherein the act of applying eyelash paint to the user's eyelashes in a multi-layered approach further comprises acts of:

fastening the second painted eyelash layer to the user using a fastener;

removing a third layer of upper eyelashes from the eyelash fastener; and applying eyelash paint to at least one eyelash of the third layer to form a third painted eyelash layer.

8. A method as set forth in claim 7, further comprising an act of removing the fasteners from the eyelashes and painted eyelash layers.

9. A method as set forth in claim 8, wherein in the act of applying eyelash paint to the user's eyelashes in a multi-layered approach, the eyelashes are painted alternately between a first eye and a second eye, such that the first painted eyelash layer is formed with respect to the first eye and then the second eye, with the second painted eyelash layer then being formed with respect to the first eye and then the second eye, and with the third painted eyelash layer then being, formed with respect to the first eye then the second eye.

10. A method as set forth in claim 9, wherein the acts of applying a patch underneath the user's lower eyelashes and fastening the user's lower eyelashes to the patch, are performed while the user's eyes are open.

11. A method as set forth in claim 1, wherein the user has upper eyelashes, lower eyelashes, and an upper eyelid, and wherein the act of fastening the user's eyelashes further comprises acts of:

applying a patch underneath the user's lower eyelashes;

fastening the user's lower eyelashes to the patch using a fastener;

applying a fastener to the user's upper eyelid; and fastening the user's upper eyelashes to the upper eyelid using an eyelash fastener.

12. A method as set forth in claim 11, wherein the acts of applying a patch underneath the user's lower eyelashes and fastening the user's lower eyelashes to the patch, are performed while the user's eyes are open.

13. A method as set forth in claim 1, wherein the user has upper eyelashes, lower eyelashes, and an upper eyelid, and wherein the act of fastening the user's eyelashes further comprises an act of fastening the user's upper eyelashes to the upper eyelid using an eyelash fastener; and wherein the act of applying eyelash paint to the user's eyelashes in a multi-layered approach further comprises acts of:

removing the first layer of upper eyelashes from the eyelash fastener, applying eyelash paint to at least one eyelash of the first layer to form a first painted eyelash layer;

fastening the first painted eyelash layer to the user using a fastener;

removing the second layer of upper eyelashes from the eyelash fastener; and applying eyelash paint to at least one eyelash of the second layer to form a second painted eyelash layer.

14. A method as set forth in claim 13, wherein the act of applying eyelash paint to the user's eyelashes in a multi-layered approach further comprises acts of:

fastening the second painted eyelash layer to the user using a fastener;

removing a third layer of upper eyelashes from the eyelash fastener; and applying eyelash paint to at least one eyelash of the third layer to form a third painted eyelash layer.

15. A method as set forth in claim 14, further comprising an act of removing the fasteners from the eyelashes and painted eyelash layers.

16. A method for multi-layer eyelash painting, comprising acts of:

fastening a user's eyelashes a against the user's face;

applying eyelash paint to the user's eyelashes in a multi-layered approach, the eyelash paint being a colored solution that provides color to the user's eyelashes when applied, wherein eyelash paint is applied to the user's eyelashes one layer at a time such that eyelash paint is applied to a first layers of eyelashes and, thereafter, eyelash paint is applied to a second layer of eyelashes, thereby providing a user with eyelashes haying eyelash paint attached thereto; and wherein in the act of applying eyelash paint to the user's eyelashes in a multi-layered approach, the eyelashes are painted alternately between a first eye and a second eye, such that a first painted eyelash layer is formed with respect to the first eye and then the second eye, with a second painted eyelash layer then being formed with respect to the first eye and then the second eye, and with a third painted eyelash layer then being formed with respect to the first eye then the second eye.

17. A method for multi-laver eyelash painting, comprising acts of:

fastening a user's eyelashes against the user's face;

applying eyelash paint to the user's eyelashes in a multi-layered approach, the eyelash paint being a colored solution that)provides color to the user's eyelashes when applied, wherein eyelash paint is applied to the user's eyelashes one layer at a time such that eyelash paint is applied to a first layer of eyelashes and, thereafter, eyelash paint is applied to a second layer of eyelashes, thereby providing a user with eyelashes having eyelash paint attached thereto; and wherein the paint applied to the first layer of eyelashes has a color that is dissimilar to a color of the paint applied to the second layer of eyelashes.

18. A method for multi-layer eyelash painting, comprising acts of:

fastening a user'eyelashes against the user's face;

applying eyelash paint to the user's eyelashes in a multi-layered approach, the eyelash paint being a colored solution that provides color to the user's eyelashes when applied, wherein eyelash paint is applied to the user's eyelashes one layer at a time such that eyelash paint is applied to a first layer of eyelashes and thereafter, eyelash paint is applied to a second layer of eyelashes, thereby providing a user with eyelashes having eyelash paint attached thereto: and wherein in applying eyelash paint to the user's eyelashes, the eyelash paint is a colored solution of a color that is dissimilar to the user's natural eyelash color.

* * * * *